US011104547B2

(12) United States Patent
Dayrell

(10) Patent No.: US 11,104,547 B2
(45) Date of Patent: Aug. 31, 2021

(54) AUTONOMOUS MOBILE LIFT

(71) Applicant: Ivan Araujo Dayrell, Belo Horizonte MG (BR)

(72) Inventor: Ivan Araujo Dayrell, Belo Horizonte MG (BR)

( * ) Notice: Subject to any disclaimer, the term of this patent is extended or adjusted under 35 U.S.C. 154(b) by 311 days.

(21) Appl. No.: 15/970,607

(22) Filed: May 3, 2018

(65) Prior Publication Data

US 2018/0319630 A1 Nov. 8, 2018

Related U.S. Application Data

(60) Provisional application No. 62/501,201, filed on May 4, 2017.

(51) Int. Cl.

| | |
|---|---|
| ***B66B 9/02*** | (2006.01) |
| ***B66B 9/00*** | (2006.01) |
| ***B66B 11/00*** | (2006.01) |
| ***B66B 11/04*** | (2006.01) |
| ***B66B 1/24*** | (2006.01) |
| *B66B 1/36* | (2006.01) |

(52) U.S. Cl.

CPC ..... *B66B 9/022* (2013.01); *B66B 1/2433* (2013.01); *B66B 1/2466* (2013.01); *B66B 9/003* (2013.01); *B66B 11/005* (2013.01); *B66B 11/0461* (2013.01); *B66B 1/36* (2013.01); *B66B 11/0446* (2013.01)

(58) Field of Classification Search

CPC ..... B66B 9/003; B66B 9/022; B66B 11/005; B66B 11/0461

See application file for complete search history.

(56) References Cited

U.S. PATENT DOCUMENTS

| | | | | |
|---|---|---|---|---|
| 561,223 | A * | 6/1896 | Hamilton | B66B 9/003 198/800 |
| 5,090,515 | A * | 2/1992 | Takahashi | B66B 9/00 187/249 |
| 5,501,295 | A * | 3/1996 | Muller | B66B 9/00 187/406 |
| 5,558,181 | A * | 9/1996 | Bundo | B66B 9/022 187/270 |
| 5,861,586 | A * | 1/1999 | McCarthy | B66B 1/2458 187/289 |
| 7,381,022 | B1 * | 6/2008 | King | B65G 1/0492 187/270 |
| 10,214,386 | B2 * | 2/2019 | Hall | B66B 5/16 |
| 10,486,941 | B2 * | 11/2019 | Finschi | B66B 9/022 |
| 2016/0075533 | A1 * | 3/2016 | Scomparin | B66B 9/022 187/240 |
| 2017/0267452 | A1 * | 9/2017 | Goren | B65G 1/0492 |

* cited by examiner

*Primary Examiner* — Minh Truong
(74) *Attorney, Agent, or Firm* — Z IP Law PLLC

(57) ABSTRACT

An elevator that incorporates a framework that allows multiple autonomous mobile lifts to move independently inside and outside a building or a group of buildings in shafts and corridors in such a way that multiple lifts can share a shaft and/or corridor.

19 Claims, 16 Drawing Sheets

Figures 1, 1B, 1C:
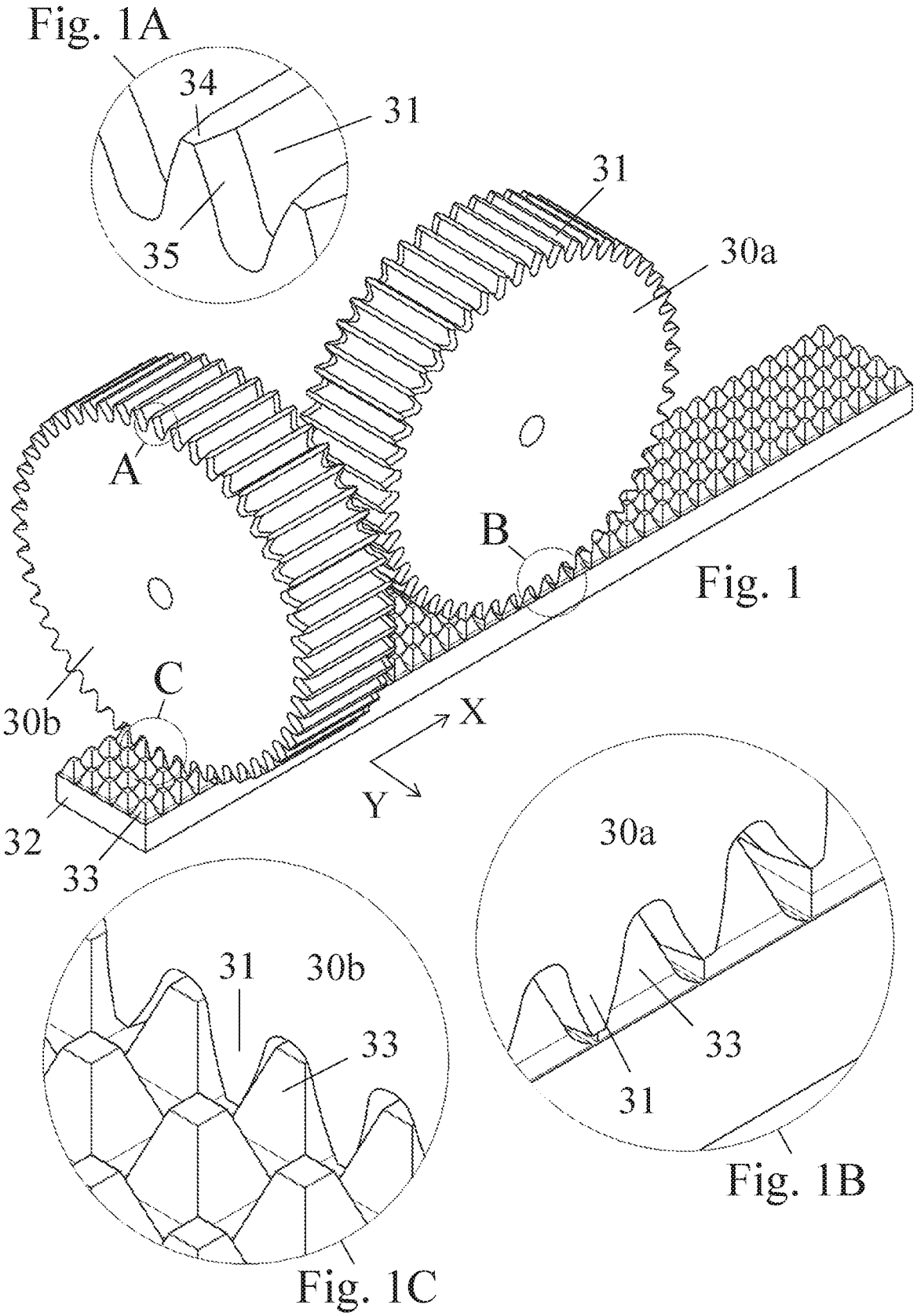

Fig. 14
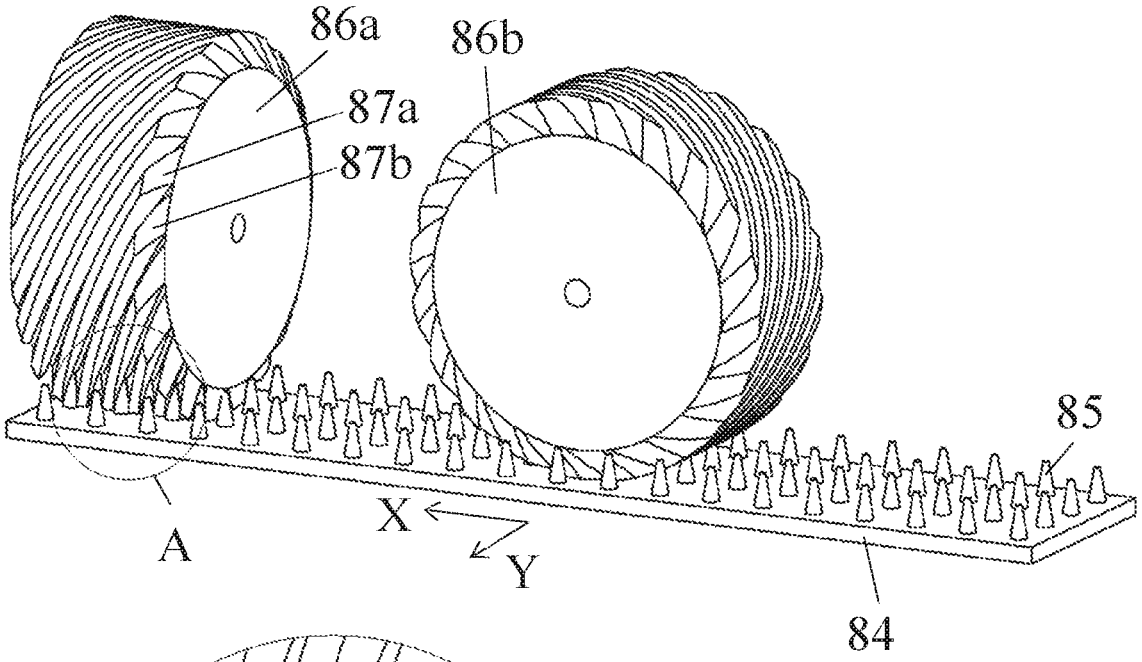
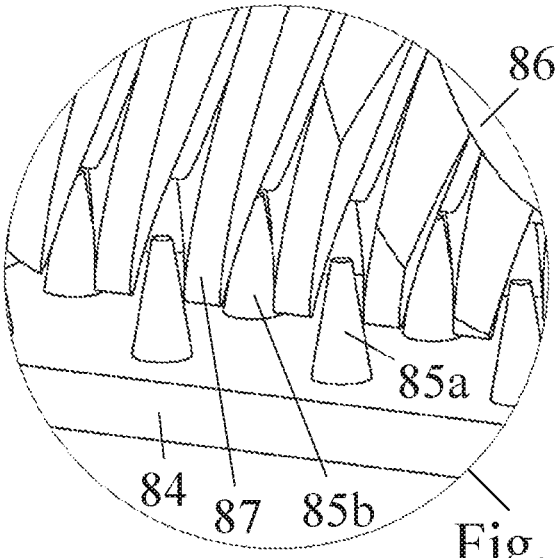
Fig. 14A

AUTONOMOUS MOBILE LIFT

CROSS-REFERENCE TO RELATED APPLICATIONS

This application claims the benefit of U.S. Provisional Patent Application No. 62/501,201 filed May 4, 2017 entitled AUTONOMOUS MOBILE LIFT which is hereby incorporated herein by reference.

FIELD OF THE INVENTION

The present invention is related to the design of an elevator that incorporates a framework that allows multiple autonomous mobile lifts to move independently inside and outside a building or a group of buildings in shafts and corridors in such a way that multiple lifts can share a shaft and/or corridor.

BACKGROUND

The elevator has evolved a lot since it was invented. Compared to early models, modern machines have a much higher level of safety and can move a larger number of passengers quicker and to higher levels.

However, despite some variations that can be found in specific niches, the basic elevator design has changed little: a stationary engine moves a cable that has a cabin attached to one end and a counterweight attached to the other. The counterweight is adjusted to balance the cabin and as a result reduce the amount of energy required to move the system up or down. This design has advantages such as simplicity, safety and speed and offers good performance for buildings lower than 20 to 30 floors. This is also one of the reasons why little has changed over the years.

The construction techniques have improved at a rapid pace, producing buildings ever taller and bigger, resulting in increasing pressure to move people to their designated floors at a reasonable throughput. This is particularly more severe in office buildings during rush hours, when the workers are arriving, braking for lunch or leaving at the same time.

As the buildings get taller, the cabins and counterweights get bigger to accommodate more passengers, the cables get longer and heavier to cope with the additional load and the elevators have to move faster to achieve the required throughput. The combined effect is a steady increase in the system weight that in turn requires more energy to accelerate the combined mass of the cabin, cable and counterweight to achieve the speed needed to provide a satisfactory throughput. It is possible to recover part of the energy during the deceleration using a supercapacitor bank installed next to the engine but this is only a partial solution that does not tackle the root of the problem.

Another simpler solution is to increase the number of elevator shafts. This however increases the area occupied by them and therefore unavailable for the intended use in the building. As the buildings grow taller, the area taken by elevator shafts increases to the point that building additional floors becomes uneconomical.

The challenge is how to move the estimated number of people at peak hours to their intended destination floors in a reasonable amount of time consuming as little space as possible. Depending on the specific conditions in each building many strategies are used to solve the problem: a) assign elevators to a range of floors; b) divide the building into sections with intermediate floors where passengers must change elevators. This allows the shafts used for the lower floors to be reused to serve the upper floors improving the efficiency of the system; c) place one cabin on top of the other so that the same elevator serves two floors at once albeit requiring users to take one flight of stairs when changing from an even to an odd floor and vice versa; d) pre assign each passenger to a specific elevator based on his destination to reduce the number of stops; e) create express elevators that go only to certain floors and back to the foyer allowing willing passengers to take a few flights of stairs to save time. This reduces the number of passengers that need to be moved by the remaining elevators and the average number of stops resulting in better efficiency.

Each strategy provides particular advantages and disadvantages that justify its use only under certain circumstances. Depending on the case, more than one strategy can be used combining advantages and disadvantages into a particular configuration.

The fact is however that, even incorporating all strategies for improvement, the traditional elevator system is unable to provide sufficient mobility for tall buildings at an affordable cost. As a result, past a certain building height the elevator system becomes the major limiting factor for buildings to get taller. A better solution is needed.

PRIOR ART

The most common system in use is still the simple standalone traditional cabin cable counterweight system where the user presses a call button to call the elevator and once inside the cabin presses the button for his desired destination. A building that has multiple elevators of this kind, will have multiple call buttons on each floor, one for each elevator. In case an inpatient user presses all buttons, all elevators will be called and will go to the calling floor and all but one of these trips will be wasted.

A slightly more sophisticated system for buildings with multiple elevators is to concentrate the operation of all elevators in a single control system. In this case, only one call button is available at each floor. The system determines what is the best suited elevator to respond to each call based on the current position, movement and remaining capacity of each elevator. This system also allows elevators to be set to skip certain floors or to go directly to a high priority floor. Overrides are available for operators at each cabin and/or at a central monitoring station.

A yet more sophisticated system that is an evolution of the single control system is to allow a computer system to control all elevators. The users are provided with a key card containing their working floor to be placed next to a scanner at the foyer or alternatively they type in the desired floor at a computerized calling pad. The computer system groups users based on an optimized algorithm and assigns elevators for the required floors depending on the changing conditions. Special arrangements may be implemented for rush hours and low load hours and to VIP passengers.

The last approach to improve the throughput is to attach two cabins one on top of the other in a double decker configuration. At the foyer, the users must take a flight of stairs or escalators half floor up or half floor down depending on their intended destination since each cabin only serves even or odd floors. A user willing to change floor inside the building must take one flight of stairs if the origin and destination floors are not both even or both odd. Having to take a flight of stairs every now and then is assumed to be a reasonable compromise, even a healthy one, to improve throughput. A reduced number of special elevators calling at each floor may be provided for disabled people or freight.

The drawback of the double decker system is that the heavy weight of the cabin system cables and counterweight requires more powerful engines and consumes more energy per passenger during low occupancy hours and users must wait for passengers on the other cabin to load and unload.

Another completely different approach is to use a hydraulic system to raise and lower the cabin instead of cables. This design requires no counterweights and allow some of the energy stored in the hydraulic fluid to be recovered improving the energy efficiency of the system. The two main disadvantages of this system are the slower speed and reduced height achievable of only a few floors. The height is limited by the practical length of the pistons that can be manufactured and the cost and complexity of a telescopic piston system spanning too many floors. It is though a good solution for areas with intense movement between adjacent floors such as airport terminals or warehouses.

There are elevators that do not use cables relying on a system of racks and gears to move the passenger or cargo cabin up and down. These are normally low speed, low capacity elevators assembled by contractors on the outside or inside an empty elevator shaft of a building under construction or renovation. As it is only a temporary fixture, once the work is complete the elevator is removed to be reused on another construction site.

ADVANTAGES

The proposed invention has been designed contemplating multiple desirable features of an elevator system producing the following advantages:

A) Low requirement on floor space. As less area is required for personal and cargo mobility inside the building, more space remains for the other intended uses inside the building lowering the mobility cost.

B) High flexibility of operation. The elevator system can be dynamically configured to offer more capacity during rush hours and less capacity during low load hours. Cargo and personal lifts can be assigned to serve all floors or only specific floors depending on time of the day or convenience. Cargo lifts that do not call at the foyer or other floors may still share the same shafts as the personal lifts without interfering with the personal service. Custom personal lifts can be assigned to an individual, such as a CEO or the owner of the penthouse and be available only for the authorized user and call at private floors only and still use the same shafts with all other elevators without interfering with any other lifts.

C) Low energy cost per transported passenger. The system collects information about intended passenger destination and groups passengers accordingly allowing the lifts to run on with a number of passengers closer to the rated capacity and on average to shorter distances. The lifts are constructed with lighter materials and as no cables and counterweights are necessary the cabin can be made lighter requiring less energy to be moved. As the lifts move down they recover part of the energy spent when they move up.

D) Reduced waiting time and ride time. The possibility to increase or reduce the number of lifts to accommodate the current passenger load enables the system to provide reduced waiting time without additional energy costs. The lifts are designed to accommodate a reduced number of passengers when compared to traditional lifts that are being replaced. As a result of a reduced number of passengers, statistically less stops are required to take all passengers to their intended destination reducing the average ride time.

E) Simple and easy scheduled and unscheduled maintenance that does not impair normal operation of the system. The individual lifts can be taken out of the shafts to a specific maintenance area allowing maintenance activities to be undertaken without interference with normal operation. In the event that a lift fails requiring unscheduled maintenance, the affected unit can be routed to the maintenance area or in case of a more serious problem to a nearby floor where it can be serviced with minor impact on the operation of the system.

F) No limitations for selected destinations other than those deliberately introduced by the building owners. All shafts and corridors have a standard rail that allow any unit to move. As a result, passenger or cargo lifts can be made to reach any point in the system in case of necessity or convenience. Any passenger or cargo elevator is able to carry a passenger or cargo from and to any floor and from end to end of the system whatever his origin and destination unless restricted by customized building rules.

G) Redundant safety devices to match or exceed the traditional elevator standards are incorporated. Built in safety devices ensure the lifts are safe for use and can cope with multiple failures without jeopardizing passenger safety.

H) Possibility to adjust the cabin shape and size to facilitate the replacement of existing elevator systems. The size and shape of the cabin can be adjusted to fit existing elevators to allow easy seamless upgrade with minimum impact for the building.

SUMMARY OF THE INVENTION

An object of the invention is a rack comprising a series of frustum shaped squared teeth allowing gears to rotate and move in one direction and slide or move in a perpendicular direction and vice versa at the same time based on the geometry of the rack.

An object of the invention is a driving train comprising a perpendicularly mounted gear pair with the rotation of a first gear moving a lift in a first direction along the rack while sliding the perpendicularly mounted second gear through the rack and the rotation of the second gear moving the lift in a second direction while sliding the perpendicularly mounted first gear through the rack, the direction of movement may be up, down, diagonally, left, right, back or front depending on the geometry of the rack.

Another object of the invention is the installation of the rack vertically along an elevator shaft and a first gear moving the lift vertically through the shaft while sliding the second gear through the rack.

Another object of the invention is the installation of the rack horizontally along a floor slab for moving the lift horizontally between a first and second elevator shaft.

Another object of the invention is installation of the rack horizontally along a floor slab between a first outer elevator shaft, along a central elevator shaft and to a second outer elevator shaft for moving the lift horizontally between the first, central and second elevator shafts.

Another object of the invention is a gear with teeth that have tapered ends to better slide against the rack teeth minimizing the chance of hitting the rack teeth and being dis-jarred from the rack due to a small misalignment between the rack and the gear or between adjacent racks.

Another object of the invention is an alternative embodiment of a rack having conical rack teeth and a driving train comprising a perpendicularly mounted propulsion screw pair with the rotation of a first propulsion screw moving a lift in a first direction along the alternative rack while sliding the perpendicularly mounted second propulsion screw through the alternative rack and the rotation of the second propulsion screw moving the lift in a second direction while sliding the perpendicularly mounted first propulsion screw through the alternative rack, the direction of movement may be up, down, diagonally, left, right, back or front depending on the geometry of the alternative rack.

Another object of the invention is the ability of an elevator constructed using the racks and gears proposed to move in any direction inside a building allowing it to access any point in the building according to the intended design.

Another object of the invention is the reduction of floor area occupied by the elevators to cope with the transportation demand by using shafts fitted with the proposed racks that can accommodate multiple elevators at the same time, dramatically increasing the transportation capacity of the system.

Another object of the invention is the flexibility introduced by the possibility of a variable number of elevators that can be increased during peak hours to cope with additional demand. Individual elevators are taken off the system during off peak hours or for maintenance to reduce energy consumption and facilitate the maintenance work.

Other objects and advantages of the present invention will become obvious to the reader and it is intended that these objects and advantages are within the scope of the present invention. To that accomplishment of the above and related objects, this invention may be embodied in the form illustrated in the accompanying drawings, attention being called to the fact, however, that the drawings are illustrative only, and that changes may be made in the specific construction illustrated and described within the scope of this application.

DRAWINGS—FIGURES

Various other objects, features and attendant advantages of the present invention will become fully appreciated as the same becomes better understood when considered in conjunction with the accompanying drawings, in which like reference characters designate the same or similar parts throughout the several views, and wherein:

| FIG. | Description | Drawing # |
|---|---|---|
| 1 | Isometric view of gear set and rack | 1 |
| 1A | Detailed view of gear tapered teeth | 1 |
| 1B | Detailed view of gear and rack vertical engagement | 1 |
| 1C | Detailed view of gear and rack horizontal engagement | 1 |
| 2 | Isometric view of elevator cabin and components | 2 |
| 3 | Isometric view of elevator cabin showing components in dashed lines | 3 |
| 4 | Isometric view of components and supercapacitor bank | 4 |
| 5 | Isometric view of gear components | 5 |
| 6 | Isometric view of wheel components | 6 |
| 7 | Isometric view of elevator cabin with deployed safety device | 7 |
| 7A | Detailed view of cabin components and safety device | 8 |
| 8 | Isometric view of cabin with deployed ladder | 9 |
| 9 | Isometric view of low floor cabin | 10 |
| 10 | Isometric view of building core showing elevator system | 11 |
| 11 | Isometric view of building core in phantom lines showing the elevator system | 12 |
| 11A | Detailed view of cabin in park position showing interaction between components | 13 |
| 12 | Multiple block building core with parking lot and disengaged elevator | 14 |
| 13 | Multiple block building core in phantom lines showing the elevator system | 15 |
| 14 | Isometric view of alternative screw and alternative rack | 16 |
| 14A | Detail view of screw and alternative rack teeth | 16 |

-continued

DRAWINGS—REFERENCE NUMERALS

| N | Item Name | Shown in FIGS. |
|---|---|---|
| 30 | driving gear | 1 2 5 7 7A 9 11A |
| 31 | gear teeth | 1 1A 1B 1C |
| 32 | rack | 1 |
| 33 | rack frustum teeth | 1 1B 1C |
| 34 | gear tooth taper | 1A |
| 35 | gear tooth taper chamfer | 1A |
| 36 | lift | 2 3 7 8 9 10 11 12 13 |
| 37 | cabin | 2 3 7 8 9 |
| 38 | cabin door | 2 3 7 8 9 |
| 39 | lift body | 2 3 7 8 |
| 40 | wheel | 2 6 8 9 |
| 41 | sensor | 2 7 7A 9 11A |
| 42 | cabin electrode | 2 7 7A 9 11A |
| 43 | emergency brake | 2 7 7A 11A |
| 44 | supercapacitor bank | 3 4 |
| 45 | driving train | 3 4 9 |
| 46 | gear support | 4 5 |
| 47 | shaft support | 4 5 |
| 48 | engine support | 4 5 6 |
| 49 | wheel support | 4 6 |
| 50 | gear holder | 5 |
| 51 | gear brake | 5 |
| 52 | worm gear | 5 6 |
| 53 | worm | 5 6 |
| 54 | worm shaft | 5 |
| 55 | bevel gear | 5 |
| 56 | engine | 5 6 |
| 57 | wheel axle | 6 |
| 58 | wheel axle support | 6 |
| 59 | wheel base | 6 |
| 60 | wheel box | 6 |
| 61 | wheel driving axle | 6 |
| 62 | wheel bevel gear | 6 |
| 63 | spiked grip | 7A |
| 64 | ladder | 8 12 |
| 65 | step | 8 |
| 66 | ladder support | 8 |
| 67 | ladder support rail | 8 |
| 68 | lift top | 9 |
| 69 | top cover | 9 |
| 70 | lower floor | 9 |
| 71 | building core | 10 11 12 13 |
| 72 | floor slab | 10 11 12 13 |
| 73 | elevator calling device | 10 12 |
| 74 | elevator door | 10 12 |
| 75 | rack lattice | 10 11 11A 13 |
| 76 | position tag | 11 11A 13 |
| 77 | building electrode | 11A |
| 78 | common floor | 12 |
| 79 | lift access gate | 12 |
| 80 | parking lot | 12 13 |
| 81 | car | 12 13 |
| 82 | lift track | 13 |
| 83 | buffer area | 13 |
| 84 | alternative rack | 14 14A |
| 85 | conical rack teeth | 14 14A |
| 86 | propulsion screw | 14 14A |
| 87 | screw teeth | 14 14A |

DETAILED DESCRIPTION—FIRST EMBODIMENT

FIG. 1 shows a rack 32 that is constructed with rack frustum teeth 33 with the same pitch in the x and y axis. The rack 32 so constructed allows a driving gear 30*a*, 30*b* with a set of gear teeth 31 of the same pitch to mesh with the rack in either the x or the y axis. The driving gear 30*a* meshes with the rack 32 along the x axis so as the driving gear 30*a* rotates it moves along the x axis. The driving gear 30*a* can also slide along the y axis independently of the movement along the x axis. When sliding along the y axis the gear teeth 31 keep the driving gear 30*a* in an aligned position along the x axis. Similarly, the driving gear 30*b* meshes with the rack 32 along the y axis so as the driving gear 30*b* rotates it moves along the y axis. The driving gear 30*b* can also slide along the x axis independently of the movement along the y axis. When sliding along the x axis the gear teeth keep the driving gear 30*b* in an aligned position along the y axis. As the rack 32 is constructed with rack frustum teeth 33 if the driving gears 30*a* and 30*b* are fixed to a frame keeping them at a fixed constant distance, the rotation of any driving gear will produce a sliding motion in the perpendicularly aligned driving gear. The driving gears fixated to a frame and perpendicular along the rack remain independent and capable for either one to rotate which at the same time causes the other perpendicularly aligned gear to slide according to the direction of the rotation.

For convenience and better visualization, the rack 32 has been drawn longer in the x axis than in the y axis. There are however no limitations for the dimensions of the rack 32 that can be constructed with as many rack frustum teeth 33 as required in any direction. Furthermore, multiple racks can be stacked along both the x and y directions to cover the area necessary to allow the intended range of movement for the driving gears in the x and y directions.

Detail FIG. 1A shows a gear tooth taper 34 produced by a gear tooth taper chamfer 35 cut into each of the gear teeth 31 of the driving gear. The gear tooth taper 34 facilitates the sliding movement of the driving gear assimilating small misalignments and gently nudging the driving gear left or right whenever needed preventing the driving gear from bumping into rack frustum teeth that are not perfectly aligned to the others due to small manufacturing deviations or imprecise installation of adjacent racks.

Detail FIG. 1B shows the gear teeth 31 of the driving gear 30*a* meshing with the rack frustum teeth 33 in the x axis.

Detail FIG. 1C shows the gear teeth 31 of the driving gear 30*b* meshing with the rack frustum teeth 33 in the y axis.

Figure 2:
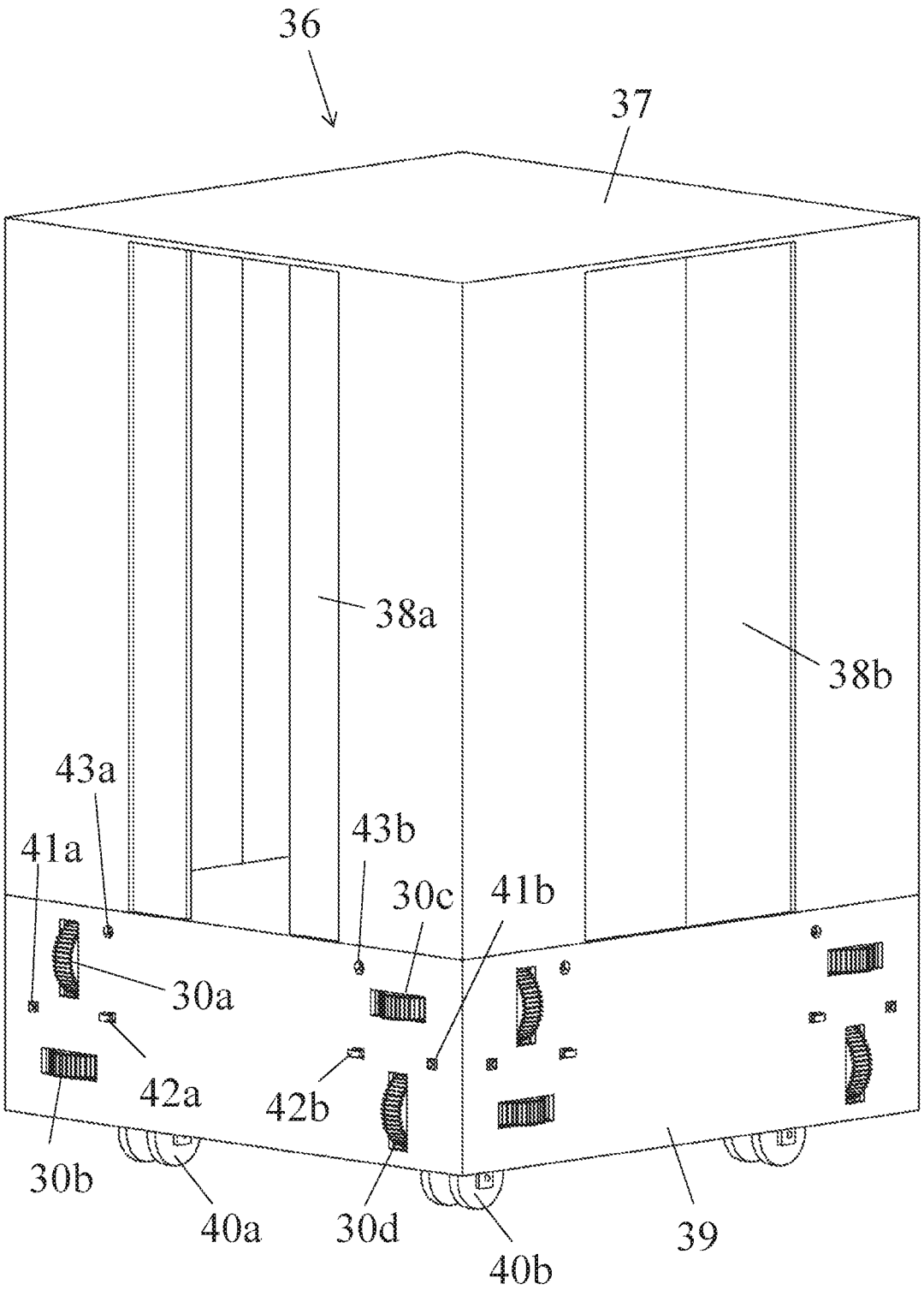

FIG. 2 shows a lift 36 composed of a cabin 37 with one or more cabin doors 38*a*, 38*b*, etc. and a lift body 39 at the base of and supporting the cabin 37. The cabin 37 is designed to accommodate and provide mechanical protection to the passengers and/or cargo as the lift 36 moves. The cabin doors 38*a*, 38*b*, etc. are designed to provide access to the cabin from one or multiple directions depending on how many cabin doors are installed and where they are located. The lift body 39 provides space to accommodate additional hardware required to operate the lift. FIG. 2 also shows a set of four wheels 40*a*. 40*b*, etc. a set of sixteen driving gears 30*a*, 30*b*, 30*c*, 30*d*, etc. a set of eight sensors 41*a*, 41*b*, etc. a set of eight cabin electrodes 42*a*, 42*b*, etc. and a set of eight emergency brakes 43*a*, 43*b*, etc. protruding from the lift body 39.

Figure 3:
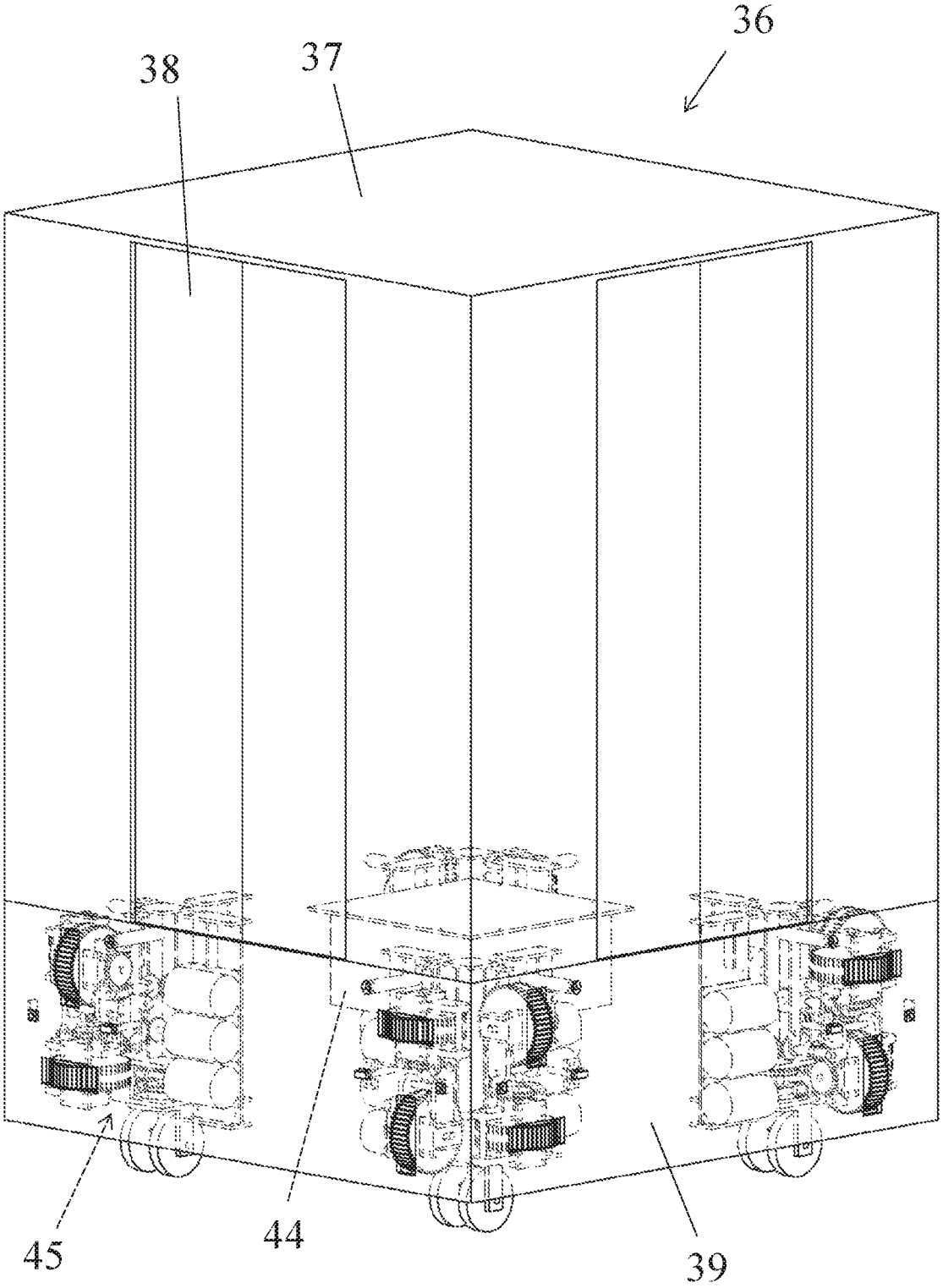

FIG. 3 shows the lift 36, the cabin 37, the cabin doors 38, and the lift body 39 with the hardware inside the lift body 39 drawn in dashed lines to show the positioning of the hardware inside the lift body 39. A power source preferably a supercapacitor bank 44 is located at the center of the lift body 39 and four identical driving trains 45 are located one on each corner of the lift body 39.

Figure 4:
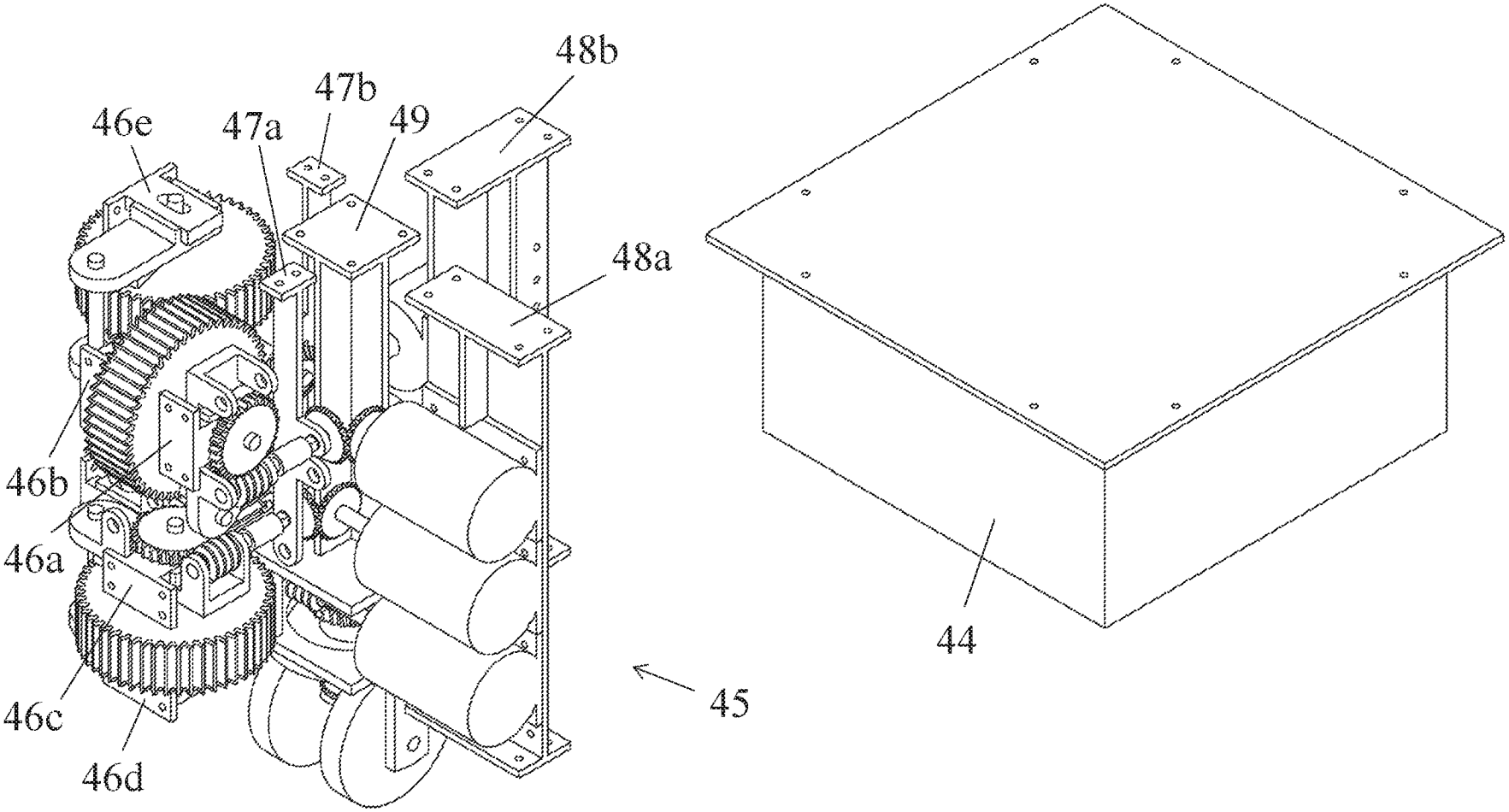

FIG. 4 shows the supercapacitor bank 44 and one driving train 45 in greater detail. The supercapacitor bank 44 is basically an array of supercapacitors designed to accumulate sufficient energy at the appropriate voltage to enable the lift to have sufficient power to carry its full load and move the maximum distance the lift can go before a recharging is necessary. For operational flexibility, a safety margin may be added allowing the lift to skip one or two recharge opportunities to avoid problems that could occur if a recharge station malfunctions. The supercapacitor bank 44 is fixated to the top of the lift body under the floor of the cabin.

FIG. 4 also shows the components of the driving train 45 that are fixated to the lift body, one set for each driving train 45: a set of gear supports 46*a*, 46*b*, 46*c*. 46*d*, 46*e*. etc. is fixated to the walls of the lift body, a set of shaft supports 47*a*. 47*b*, etc. a set of engine supports 48*a*, 48*b* etc., and a set of wheel supports 49 are fixated to the top of the lift body under the floor of the cabin.

Figure 5:
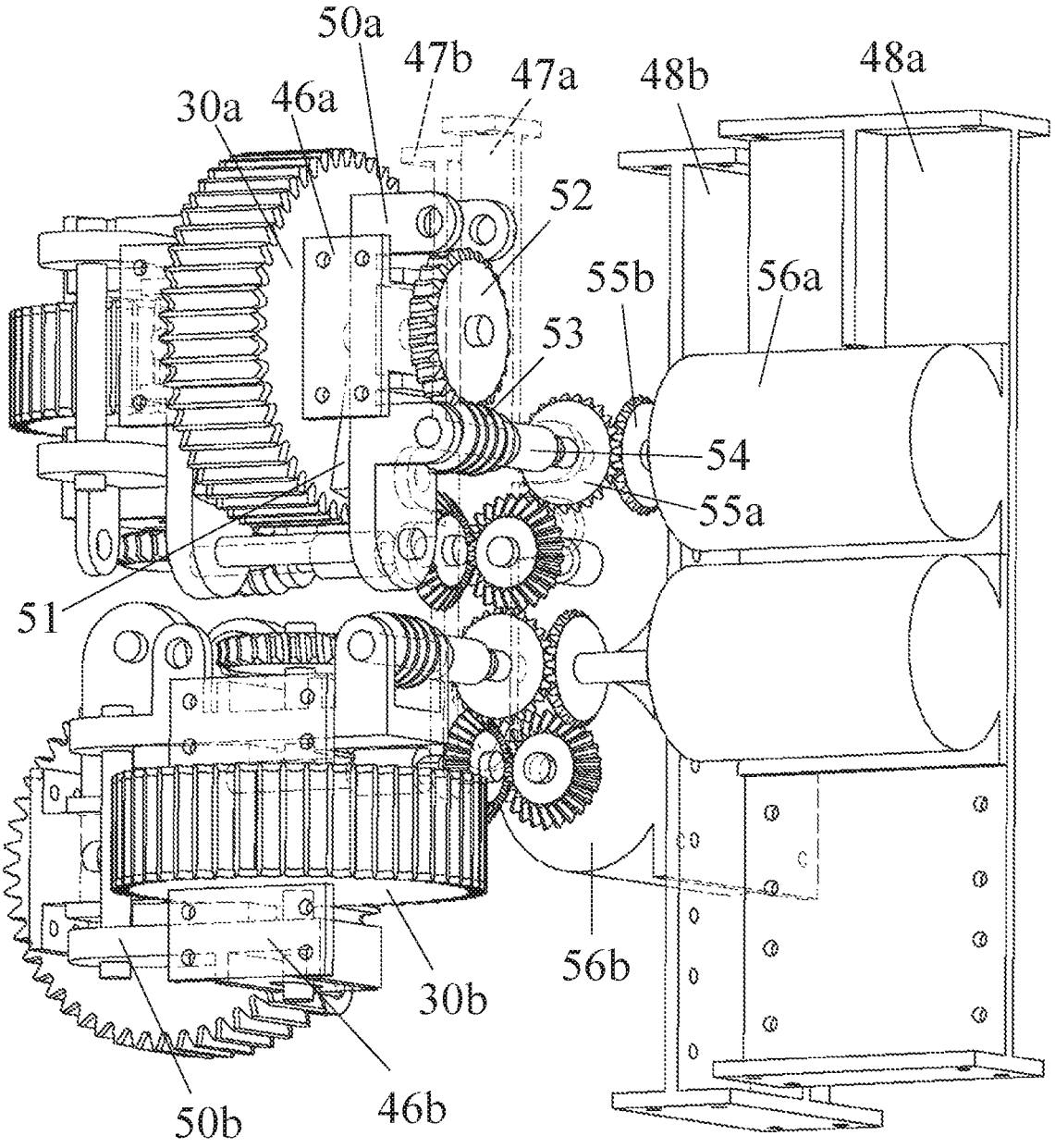

FIG. 5 shows the gear components of the driving train in greater detail. The gear supports 46*a*, 46*b*, etc. are fixated to the walls of the lift body, and provide support for a set of gear holders 50*a*, 50*b*, etc. that hold the driving gears 30*a*, 30*b*, etc. in place with the first driving gear 30*a* positioned and fixated perpendicularly to the second driving gear 30*b*. The gear holders 50*a*, 50*b*, etc. allow the driving gears to slide in and out with respect to the gear supports 46*a*, 46*b*, etc. to accommodate variations in the depth to the gear teeth within the rack frustum teeth ensuring that the driving gears remain always in contact with the racks.

The driving gears 30*a*. 30*b*, etc. are powered by engines 56*a*, 56*b*, etc. mounted in adequate engine supports 48*a*. 48*b* through a mechanical drivetrain that can be implemented using a worm gear 52, a worm 53, a worm shaft 54 and a set of bevel gears 55*a*, 55*b* as drawn or another equivalent mechanical solution. The worm shafts 54 are held in place by the shaft supports 47*a*. 47*b*, etc. The engines 56*a*, 56*b*, etc. provide power to move the gears when the lift is rising or moving on a flat surface taking the electric energy from the supercapacitor bank. When the lift is going down, the engines 56*a*, 56*b*, etc. are used as generators to recover energy and provide braking power to prevent the lift from accelerating down. The recovered energy is injected back into the supercapacitor bank. A gear brake 51 is installed on each gear holder 50*a*, 50*b*, etc. to allow for additional braking whenever necessary.

Figure 6:
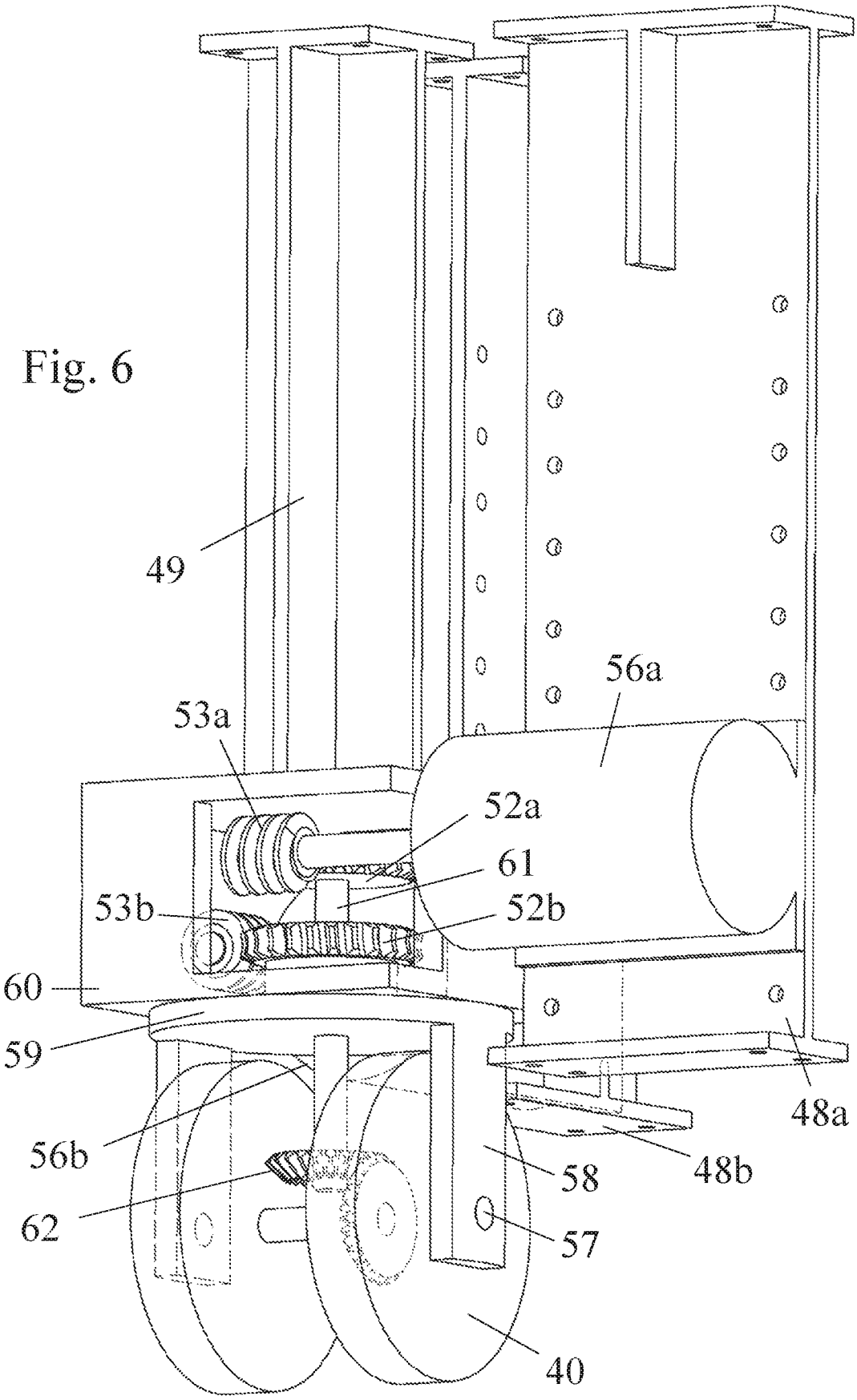

FIG. 6 shows the wheel components of the driving train in greater detail. The wheel 40 is driven by wheel axle 57 that is held in place by a wheel axle support 58 that is mounted in a wheel base 59 that is allowed to rotate with respect to a fixed wheel box 60 that is supported by the wheel support 49. The wheel axle 57 is driven by a wheel bevel gear 62 that conveys power from an engine 56*a* through a worm gear 52*a*, a worm 53*a*, a and a wheel driving axle 61. As the shaft of the engine 56*a* that is held in place by the engine support 48*a* turns in a clockwise or counter-clockwise direction, the wheel 40 is driven forwards or backwards.

The wheel base 59 is able to rotate controlled by the engine 56*b* that drives a worm 53*b* that is geared to a worm gear 52*b* that is fixed to the wheel base 59. As the shaft of the engine 56*b* that is held in place by the engine support 48*b* turns in a clockwise or counter-clockwise direction, the orientation of the wheel base 59 is adjusted to the intended direction. The lift can therefore move without the rack and pickup and transport personal and cargo outside of the elevator shaft such as along corridors or out of doors within parking lots.

Figure 7:
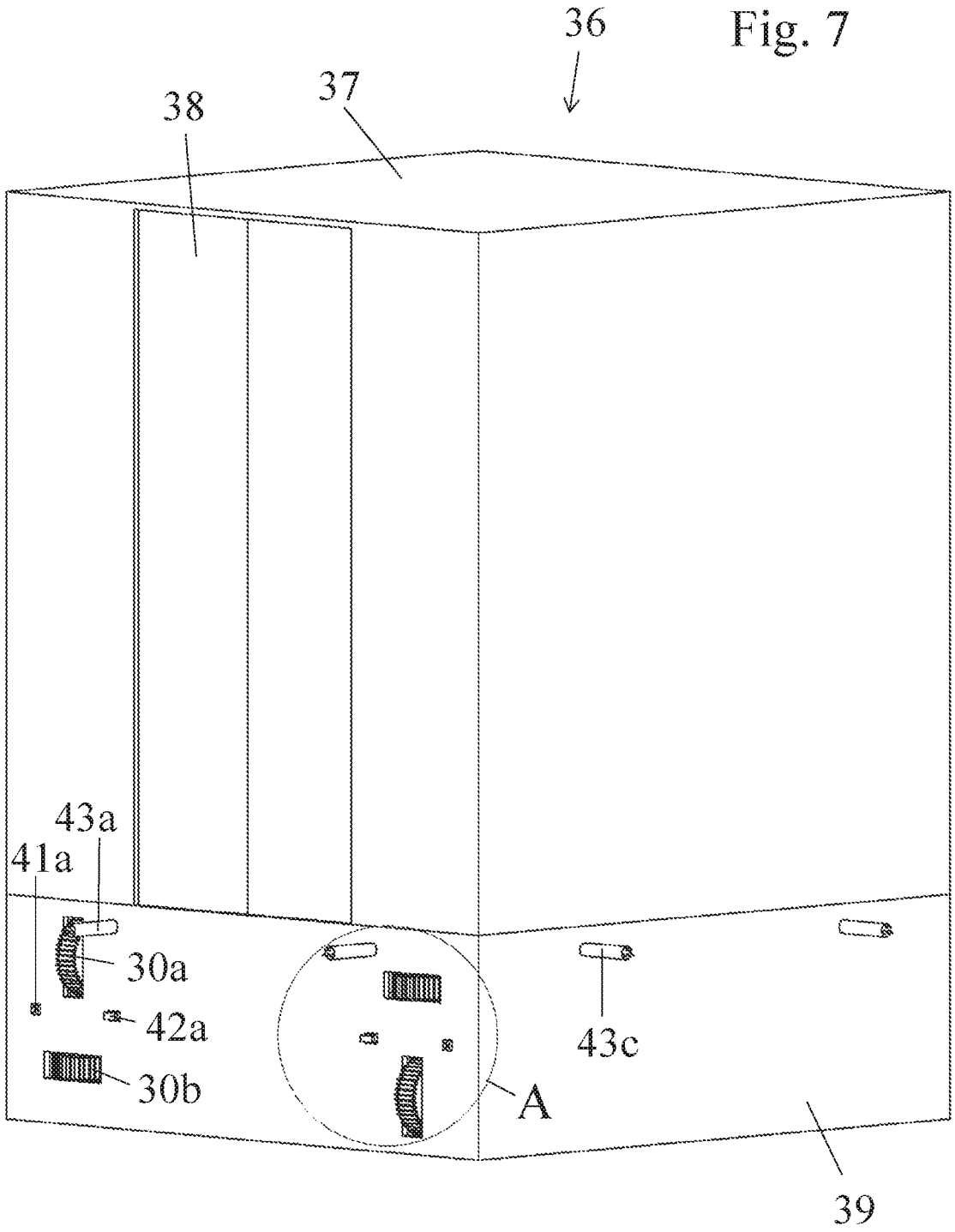

FIG. 7 shows an embodiment of the lift 36 in a configuration without wheels, with the cabin 37 equipped with only one set of cabin doors 38. The lift body 39 is equipped with a set of eight driving gears 30*a*, 30*b*, etc. (four in the front and four in the back that are not visible from the viewing angle); a set of four sensors 41*a*, etc. (two in the front and two in the back that are not visible from the viewing angle); a set of four cabin electrodes 42*a*, etc. (two in the front and two in the back that are not visible from the viewing angle); and a set of eight emergency brakes 43*a*, 43*c*, etc.

Figure 7A:
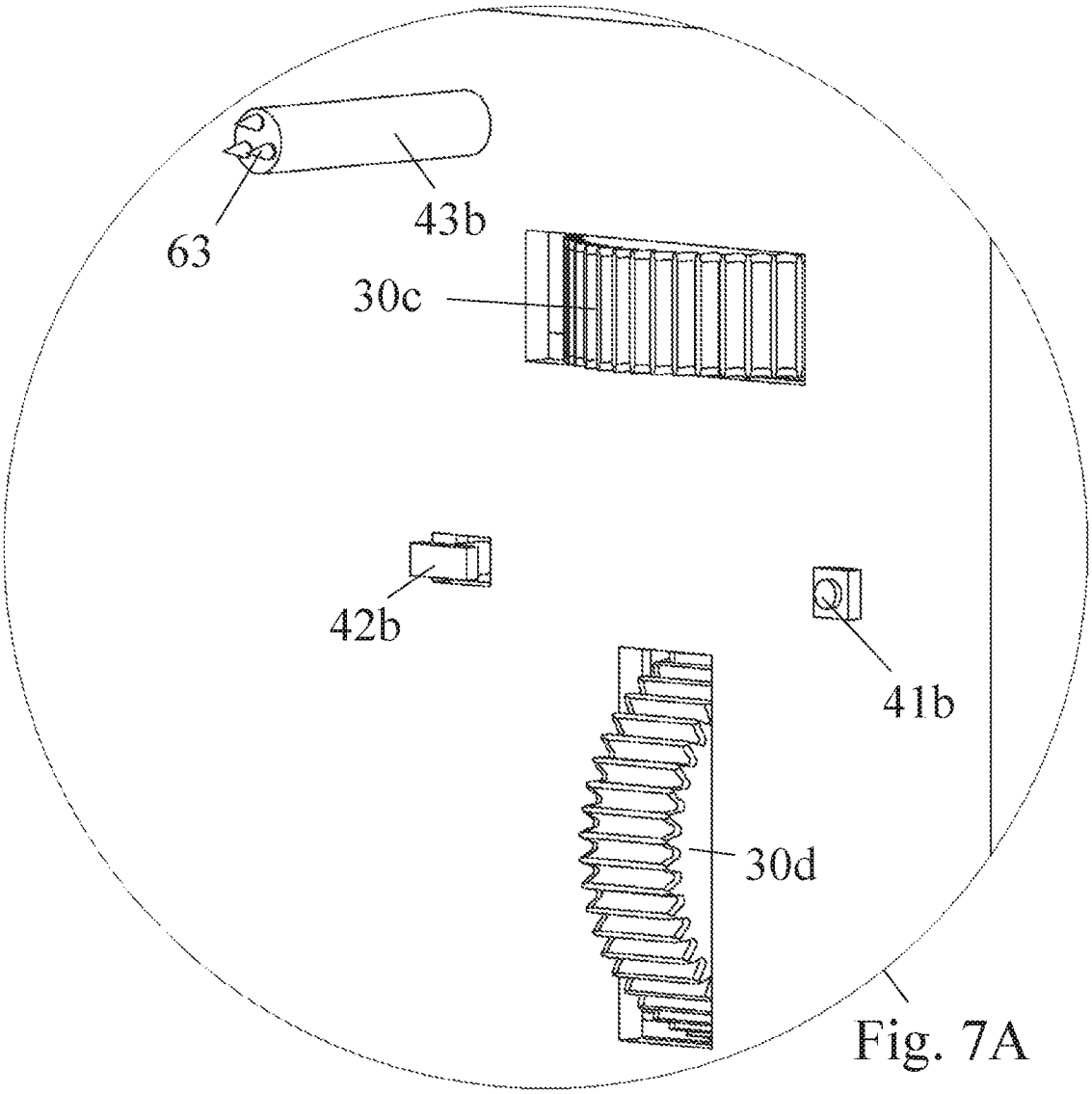

Detail FIG. 7A shows the driving gears 30*c* and 30*d*; the sensor 41*b*; the cabin electrode 42*b*; and the emergency brake 43*b* in greater detail. A spiked grip 63 at the end of the emergency brake 43*b* creates additional friction and helps the emergency brake to lock against the elevator shaft walls when deployed.

Figure 8:
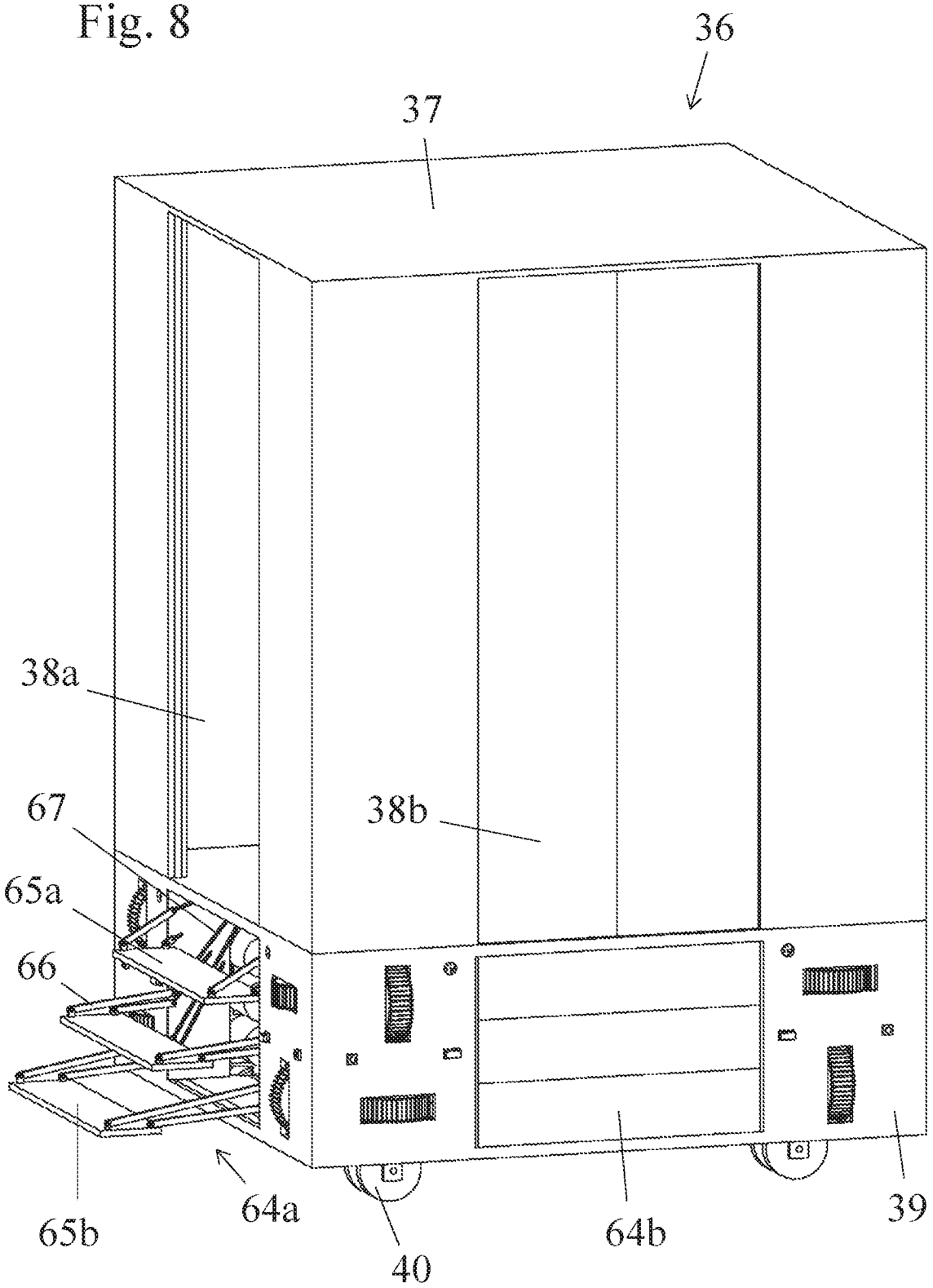

FIG. 8 shows an embodiment of the lift 36 in a configuration intended for operation inside and outside a building with the cabin 37 equipped with four cabin doors 38*a*. 38*b*, etc. and a set of wheels 40. The lift body 39 is equipped with a set of four ladders 64*a*, 64*b*, etc. that allow passengers to climb into the cabin 37 when the lift is outside the lift shaft, for example in a corridor or parking lot. Each ladder 64*a*, 64*b*, etc. is composed of a set of steps 65*a*, 65*b*, etc., each step supported by a ladder support 66 that is guided by a ladder support rail 67 in such a way that when the ladder support 66 moves to one end of the ladder support rail 67, the ladder 64*a* is in the deployed position and when the ladder support 66 moves to the other end of the ladder support rail 67, the ladder 64*b* is in the stowed position.

Figure 9:
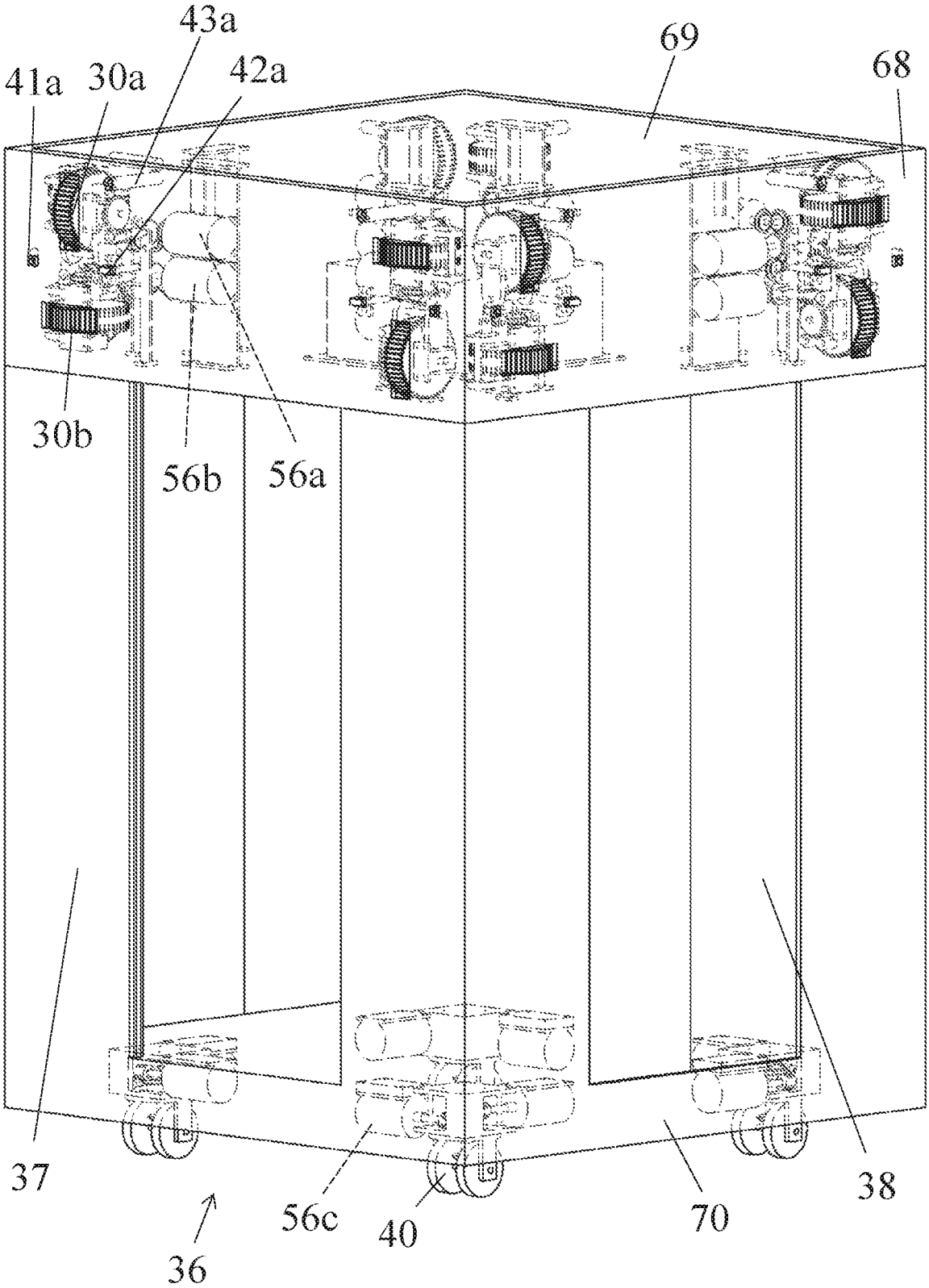

FIG. 9 shows an embodiment of the lift 36 in an easy access configuration that has no ladders, intended to facilitate passenger access to the cabin 37, specially for passengers with disabilities. The cabin 37 has a lower floor 70 and is equipped with four cabin doors 38 and a set of wheels 40. The engines 56*c*, etc. driving the wheels 40 are mounted on the bottom of the cabin 37.

A lift top 68 is fitted with all the gear components of the driving train such as the engines 56*a*, 56*b*, etc. driving the corresponding driving gears 30*a*, 30*b*, etc. plus the sensors 41*a*, etc.; the cabin electrodes 42*a*, etc.; and the emergency brakes 43*a*, etc. to allow the floor to be as low as possible. A top cover 69 closes the lift top 68 and provides protection from the elements, especially when the lift 36 operates outdoors.

Figure 10:
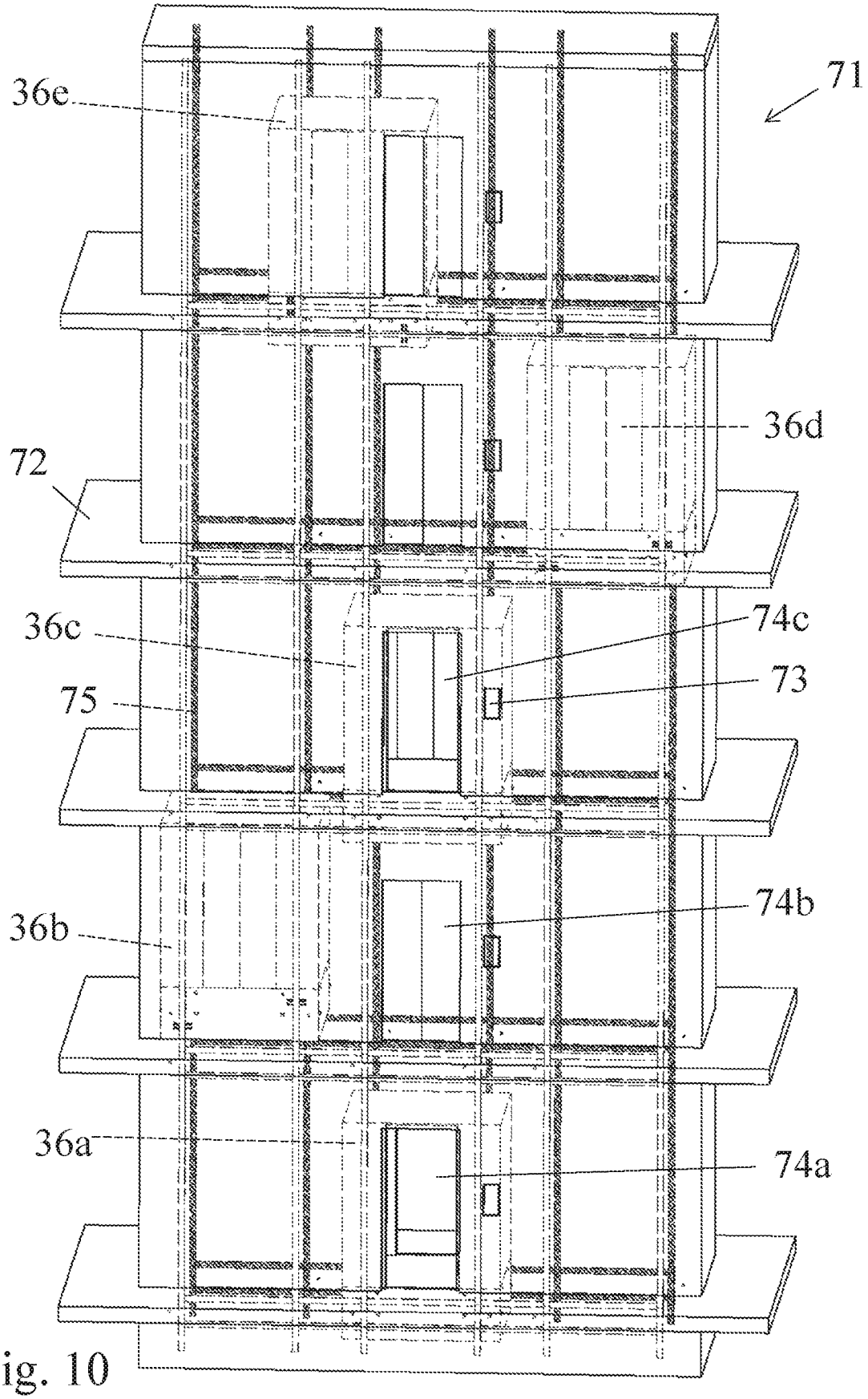

FIG. 10 shows a building core 71 depicting only the elevator shafts and a small part of the surrounding floor slab 72 with an elevator calling device 73 installed on each floor. A set of elevator doors 74*a*, 74*b*, 74*c*, etc. are installed to prevent access to the elevator shaft unless one of the lifts 36*a*. 36*b*, 36*c*, 36*d*, 36*e* is stationed at the proper position in front of the corresponding elevator doors. The lifts 36*a*, 36*b*, 36*c*, 36*d*, 36*e* move up and down in the building using a rack lattice 75 having vertical left and right rails that are fixated to the inner walls of the elevator shafts and horizontal left and right rails that are fixated along a floor slab 72 extending from a first elevator shaft to a second elevator shaft. The rack lattice 75 provides a number of lanes for the lifts to move in the up, down, left and right direction and stop. The central lane in front of the elevator doors is intended for the lifts to stop so the passengers can get in and out. The outer lanes are intended for the lifts to move up or down.

In FIG. 10 the lifts 36*a* and 36*c* are stationed in the central lane in front of the corresponding elevator doors 74*a* and 74*c* respectively that are open. The first floor is equipped with elevator doors 74*a* at both sides so passengers can get in from one side and get out to the other side allowing a better flow of passengers. Both elevator doors in the first floor and the cabin doors of the lift 36*a* stationed in the first floor are open allowing a through view of the lift and to the other side of the first floor.

The other floors are equipped with elevator doors only at the front side. The front elevator doors 74*c* and the cabin doors of the lift 36*c* stationed in the third floor are open allowing a through view of the lift until the cabin doors at the back of the lift 36*c* that are closed. The elevator doors 74*b* are closed as no lift is stationed in the second floor.

The lift 36*b* is moving down in the outer left lane and the lift 36*d* is moving up in the outer right lane. To change the direction of movement, a lift goes through the central lane and may or may not stop to drop or collect passengers. The lift 36*e* is moving from the central lane to the outer left lane to go down.

Figure 11:
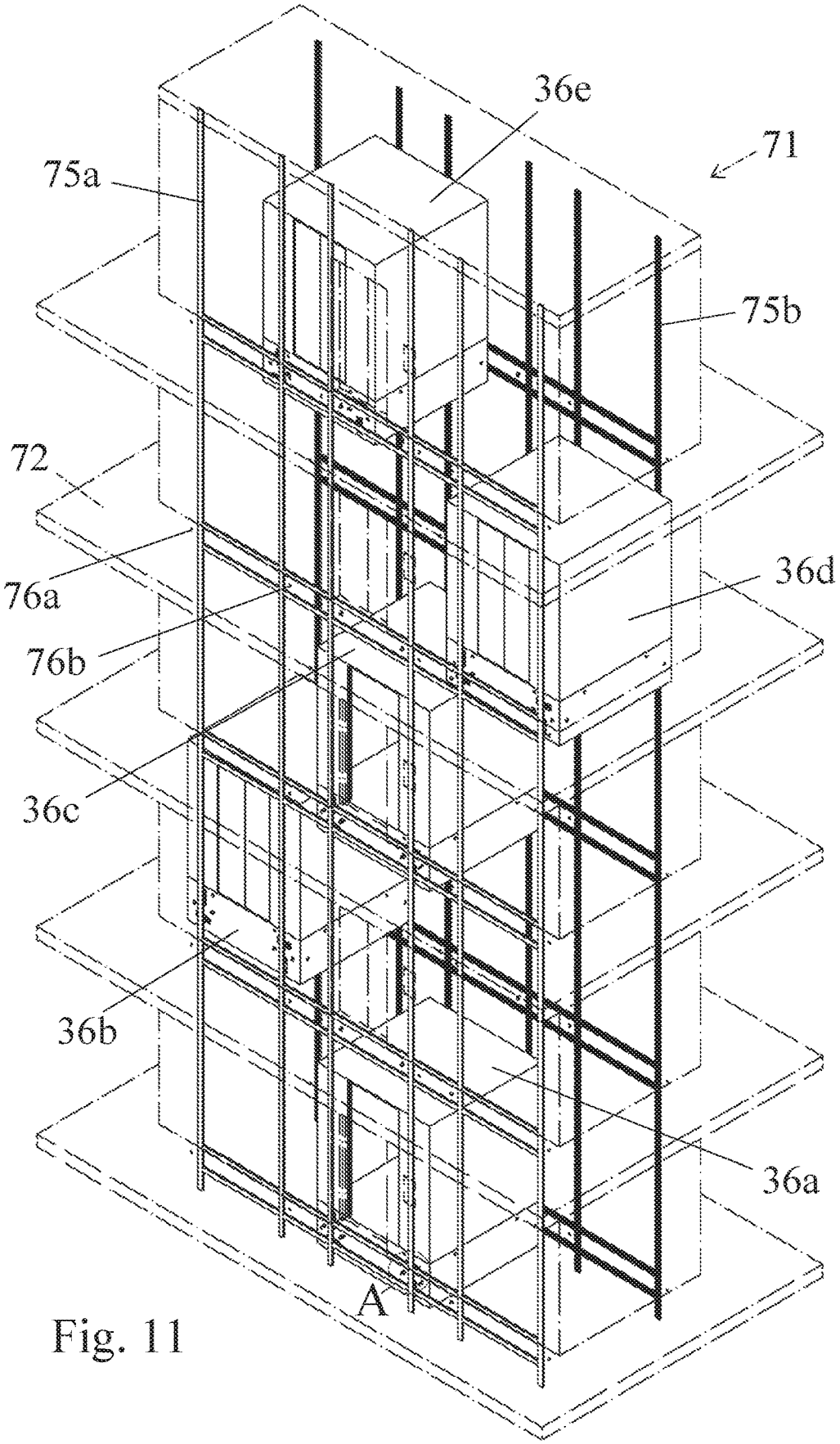

FIG. 11 shows the building core 71 with all floor slabs 72 drawn in phantom lines to allow a better view of the system. The rack lattice 75*a* is fixated to the front inner walls of the elevator shaft and the rack lattice 75*b* is fixated to the back inner walls of the elevator shaft. The lifts 36*a*, 36*b*, 36*c*. 36*d*, 36*e* are supported and run in the lanes provided by the rack lattice 75*a* and 75*b*. A set of position tags 76*a*, 76*b*, etc. positioned at key points in the building core 71 serve as reference points to ascertain the position of the lifts moving around the building core 71. The position tags are placed in such a way to align with the corresponding sensors in the lifts. To improve security there are redundant position tags so that in case one particular position tag or a sensor in a lift fails, it is still possible to ascertain the position of the lifts using another pair of a position tag and the corresponding sensor positioned to read it. In alternative embodiments, the sensors may be placed at key points along the building core 71 and the position tags 76 may be placed on the lifts.

Figure 11A:
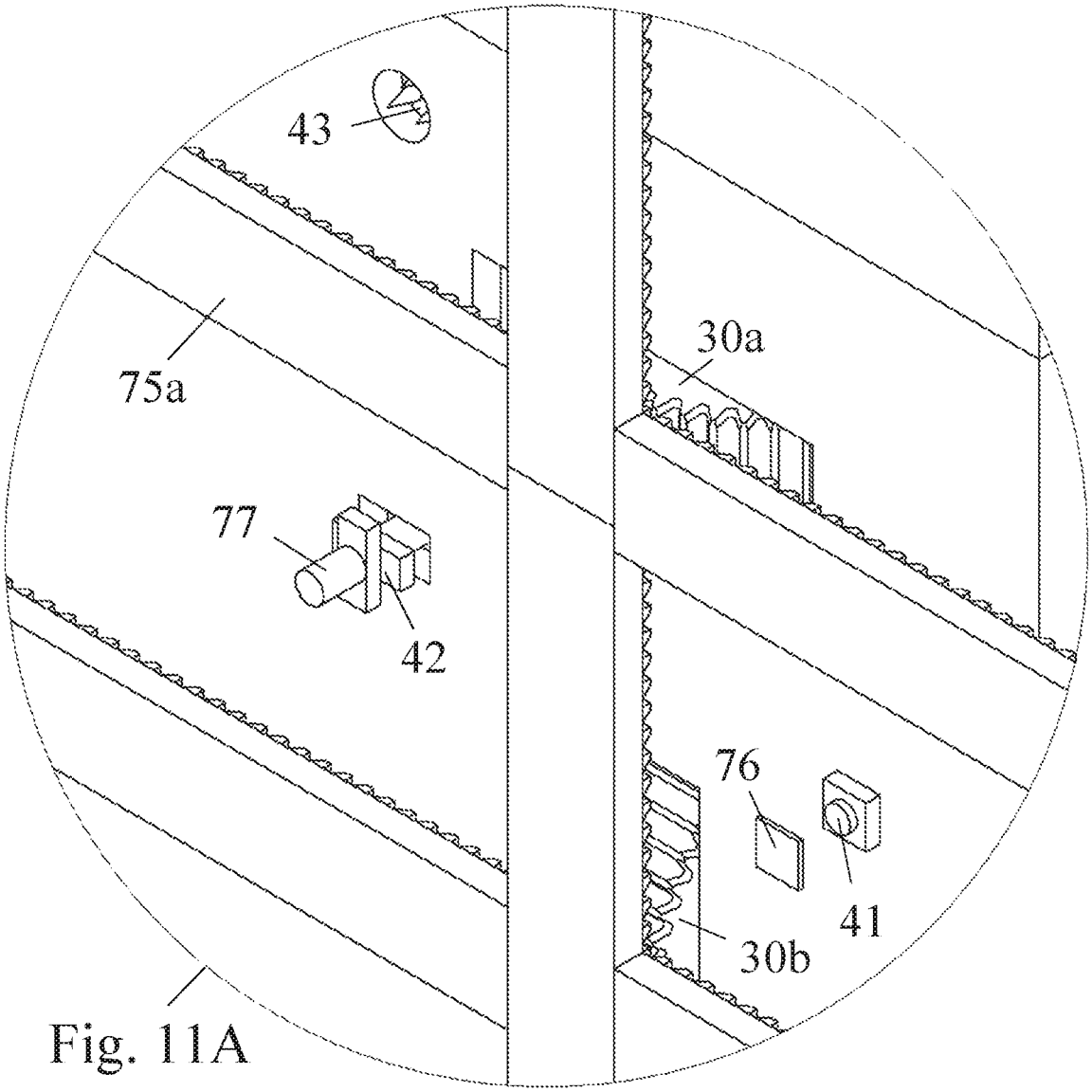

Detail FIG. 11A shows a zoomed view of the lift stationed in the first floor with the emergency brakes 43 in the stowed position. The lift is kept in place by the stationary driving gears 30*a* and 30*b* engaged in the rack lattice 75*a*. The proper position to stop so the elevator doors align with the cabin doors is determined by the alignment of the sensor 41 with the position tag 76. In this position, a building electrode 77 aligns and has electrical contact with the cabin electrode 42 to supply energy to recharge the supercapacitor bank to allow the lift to move further.

Figure 12:
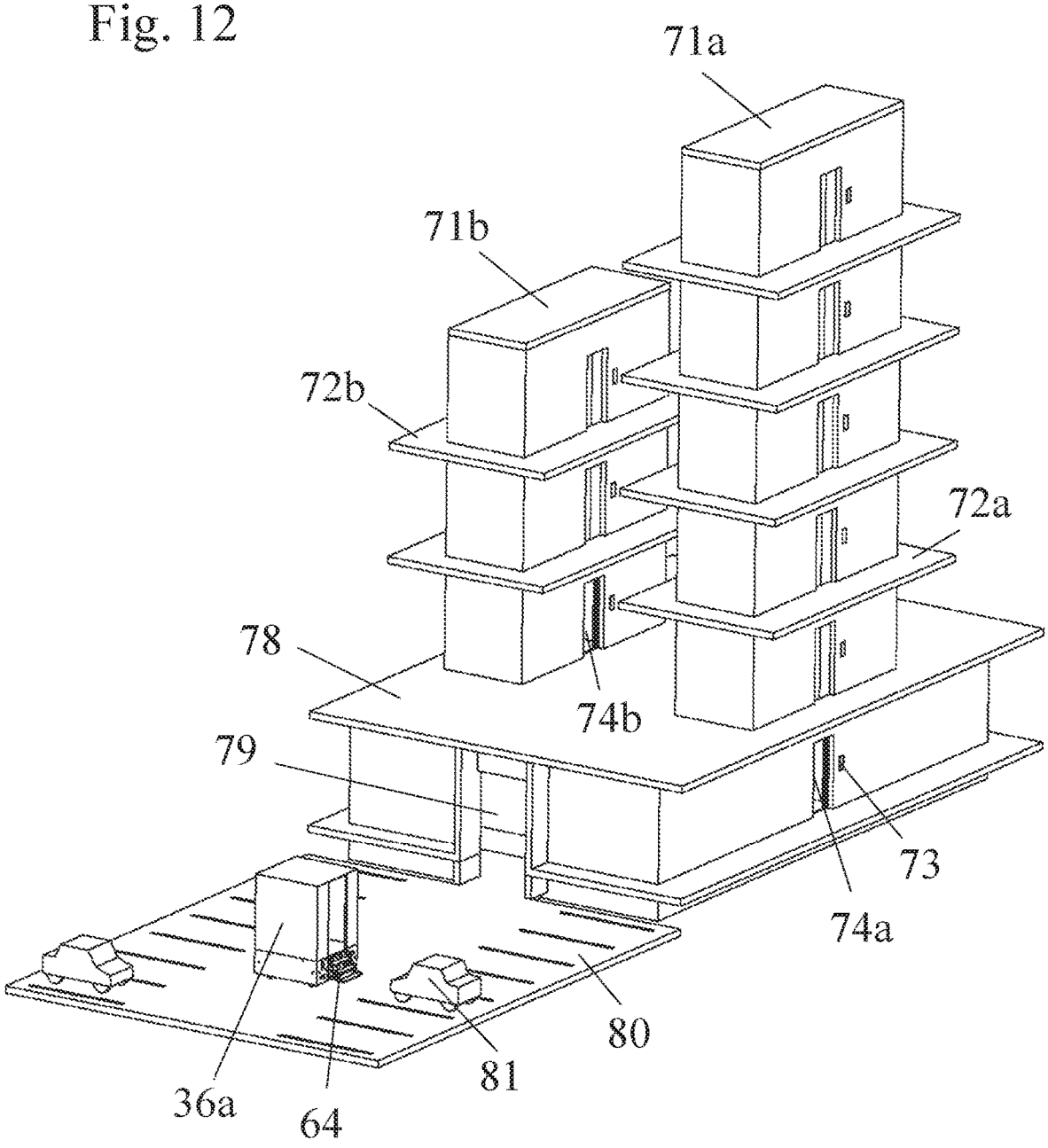

FIG. 12 shows a more sophisticated building with two building cores 71*a* and 71*b* each one with multiple floor slabs 72*a* and 72*a* respectively. One elevator calling device 73 is installed next to each of the elevator doors 74*a*, 74*b*, etc. A common floor 78 connects both buildings and a lift access gate 79 provides access to a common parking lot 80 so a lift 36*a* equipped with ladders 64 can collect and drop passengers at the spot they parked their car 81.

Figure 13:
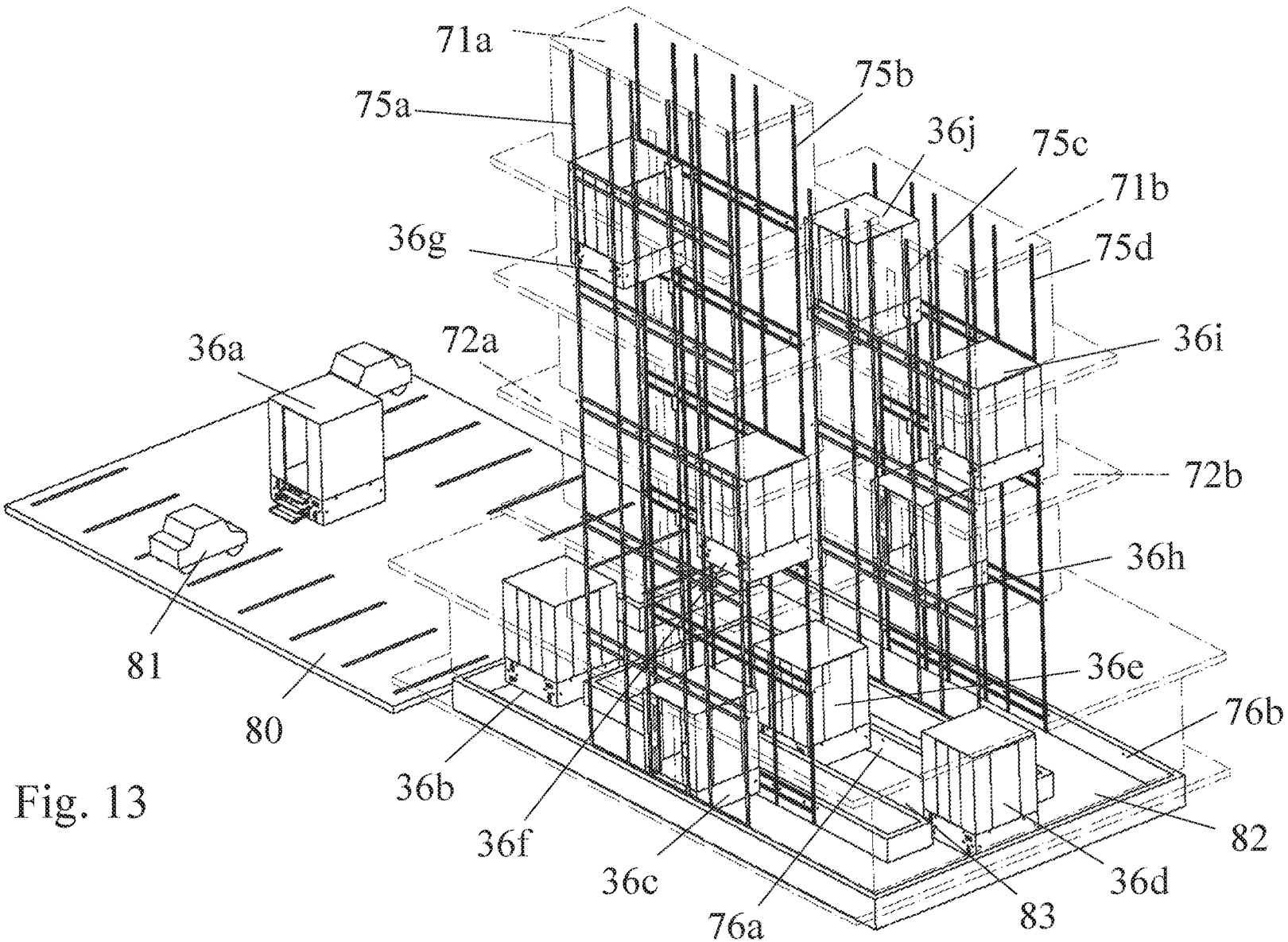

FIG. 13 shows the same building illustrated in FIG. 12 from another view point and with the two building cores 71*a* and 71*b* and all floor slabs 72*a* and 72*a* drawn in phantom lines to allow the view of the interior of the building and of the installed equipment. As seen in FIG. 12, also in FIG. 13, a lift 36*a* equipped with ladders 64 is at the parking lot 80 collecting or dropping passengers at the spot they parked their car 81.

Inside both building cores 71*a* and 71*b*, four rack lattices 75*a*, 75*b*, 75*c*, and 75*d* are installed to provide lanes for the lifts to move up, down, left, right, and stop. The lifts may move up and down within the central lane. The central lane is also intended for the lifts to stop (36*c*, 36*h*) so the passengers can get in and out. The outer lanes are intended for the lifts to move up (36*f*, 36*i*) or down (36*g*, 36*j*). A set of position tags 76*a*, 76*b*, etc. positioned at key points serve as reference points to ascertain the position of the various lifts in the system as they move around the area.

A lift track 82 allows the lifts to get off the rack lattice 75 using their wheels to move from one building core to another (36*b*); go to the parking lot 80 (36*a*); or go to a buffer area 83 (36*d*) where lifts off duty can be temporarily removed from the system to save energy at reduced demand hours and wait until needed or receive maintenance (36*e*). It is also possible to use lift tracks 82 in a specific floor to grant direct lift access to specific rooms or apartments inside the building.

OPERATION—FIRST EMBODIMENT

The arrangement shown in FIG. 1 with two driving gears 30*a*, 30*b* perpendicular to each other allows for independent movement in both the x and y axis. The driving gears 30*a*, 30*b* remain in the same relative position, fixed to the supporting and driving structures (not shown to better illustrate the basic components). The driving gear 30*a* meshes with the rack 32 along the x axis so as the driving gear 30*a* rotates it moves along the x axis. The driving gear 30*a* can also slide along the y axis independently of the movement along the x axis. When sliding along the y axis the gear teeth 31 keep the driving gear 30*a* in a steady position in the x axis. Similarly, the driving gear 30*b* meshes with the rack 32 along the y axis so as the driving gear 30*b* rotates it moves along the y axis. The driving gear 30*b* can also slide along the x axis independently of the movement along the y axis. When sliding along the x axis the gear teeth keep the driving gear 30*b* in a steady position in the y axis. The rotation of any driving gear will produce a sliding motion in the other driving gear. The driving gears fixated to a frame remain independent and capable to rotate at the same time causing the other gear to slide according to the direction of the rotations.

The rack 32 can be constructed with as many rack frustum teeth 33 as required in any geometry to allow for movement of the gears of the driving train in any direction, up, down, diagonally, front, back, left or right. Multiple racks can be tiled along both the x and y directions to cover the area necessary to allow the intended range of movement and an additional safety range for the driving gears in the x and y directions. The lift 36 may be configured with as many driving trains 45 as necessary to access and maneuver along the installed racks.

Detail FIG. 1A shows the gear tooth taper 34 produced by gear tooth taper chamfer 35 cut into each of the gear teeth 31 of the driving gear. The gear tooth taper 34 facilitates the sliding movement of the driving gear assimilating small misalignments and gently nudging the driving gear left or right whenever needed preventing the driving gear from bumping into a rack frustum teeth that is not perfectly aligned to the others due to small manufacturing deviations or imprecise installation of adjacent racks.

FIG. 5 shows the gear components of the driving train in greater detail. The gear supports 46*a*. 46*b*, etc. are fixated to the walls of the lift body, and provide support for the gear holders 50*a*, 50*b*, etc. that hold the driving gears 30*a*, 30*b*, etc. in place and allow them to slide in and out with respect to the gear supports 46*a*, 46*b*, etc. to accommodate variations in the distance to the racks where the gears are geared ensuring the driving gears remain always in contact with the racks.

The driving gears 30*a*, 30*b*, etc. are powered by engines 56*a*, 56*b*, etc. mounted in the engine supports 48*a*, 48*b* through a mechanical drivetrain. The engine 56*a* transmits power to the bevel gear 55*a* that transfers the power to the worm 53 through the worm shaft 54. The worm shafts 54 are held in place by the shaft supports 47*a*. 47*b*, etc. The engines 56*a*, 56*b*, etc. provide power to move the gears when the lift is rising or moving on a flat surface taking the electric energy from the supercapacitor bank. When the lift is going down, the engines 56*a*, 56*b*, etc. are used as generators to recover energy and provide braking power to prevent the lift from accelerating down. The recovered energy is injected back into the supercapacitor bank. The gear brake 51 installed on each gear holder 50*a*, 50*b*. etc. allows for additional braking whenever necessary.

FIG. 6 shows the wheel components of the driving train in greater detail. The engine 56*a* powers the worm 53*a* that is engaged to the worm gear 52*a* mounted in the wheel driving axle 61. The wheel driving axle 61 transfers the power to the wheel bevel gear 62 that drives the wheel axle 57 where the wheel 40 is installed. As the engine 56*a* rotates left or right it turns the wheel 40 in the intended direction at the desired speed.

The engine 56*b* powers the worm 53*b* that is engaged to the worm gear 52*b* mounted in the wheel base 59. As the engine 56*b* rotates left or right it turns the wheel base 59 to set the orientation of the wheel 40 to the intended direction. Each of the four wheels has its independent set of engines to control its orientation, direction of movement and speed.

Detail FIG. 7A shows the emergency brake 43*b* with spiked grips 63 at the end that creates additional friction and helps the emergency brake to lock against the elevator shaft walls when deployed to slow down and stop the lift.

FIG. 8 shows the lift 36 in a configuration intended for operation inside and outside a building with the cabin 37 equipped with four cabin doors 38*a*, 38*b*, etc. and a set of wheels 40. The lift body 39 is equipped with four ladders 64*a*, 64*b*, etc. that allow passengers to climb into the cabin 37 when the lift is outside the lift shaft, for example in a parking lot. Each ladder 64*a*, 64*b*, etc. is composed of a set of steps 65*a*, 65*b*, etc., each step supported by a ladder support 66 that is guided by a ladder support rail 67 in such a way that when the ladder support 66 moves to one end of the ladder support rail 67, the ladder 64*a* is in the deployed position and when the ladder support 66 moves to the other end of the ladder support rail 67, the ladder 64*b* is in the stowed position.

FIG. 10 shows a building core 71 depicting only the elevator shafts and a small part of the surrounding floor slab 72 with an elevator calling device 73 installed on each floor. When a user wants to call a lift instead of just pressing a calling button he types in the intended destination using the touch screen of the elevator calling device 73. The system selects the best option of available lifts to go to that floor and pick up the user, based on a number of criteria such as estimated arrival time, available capacity, destination, etc. to optimize operation, reduce energy costs and minimize the average travel time.

The lifts 36*a*. 36*b*, 36*c*, 36*d*, 36*e* move up and down in the building using the rack lattice 75 that is fixated to the inner walls of the elevator shafts. The rack lattice 75 provides a number of lanes for the lifts to move and stop. The central lane in front of the elevator doors 74*a*, 74*b*, 74*c*, etc. is intended for the lifts to stop so the passengers can get in and out. The outer lanes are intended for the lifts to move up or down, for example the outer lane on the right is for the lifts to move in an upward direction and the outer lane on the left is for the lifts to move in a downward direction. To increase capacity a second pair of outer lanes may be added so that the lifts have two lanes to go up and two lanes to go down. The center lane is for the lifts to stop and may be used for short hops of floors, the outer lanes adjacent to the central lane are moving lanes (up and down respectively) and the outer most lanes are high speed lanes. This arrangement allows a lift leaving the central lane to accelerate in the adjacent up or down lane and move to the next adjacent high speed outer lane in case it needs to move a greater distance or needs to overcome another lift. A lift moving in the outer most lane moves into the outer lane to decelerate and then to the central lane to stop and allow passengers to enter or exit.

In FIG. 10 the first floor (foyer) that has higher demand is equipped with elevator doors 74*a* at both sides so passengers can get in from one side and get out to the other side allowing a better flow of passengers. The other floors are equipped with elevator doors only at the front side.

If necessary additional elevator doors may also be installed in the outer moving lanes in the first floor (foyer) allowing for several spots to load and unload passengers simultaneously. Once ready the lifts follow their intended route according to the availability of a path to the moving lanes waiting for a lift in front to move if necessary.

FIG. 11 shows the building core 71 will all floor slabs 72 drawn in phantom lines to allow a better view of the system. The lifts 36*a*, 36*b*, 36*c*. 36*d*, 36*e* are supported and run in the lanes provided by the rack lattice 75*a* and 75*b*. The position tags 76*a*. 76*b*, etc. are placed in such a way to align with the corresponding sensors in the lifts and positioned at key points in the building core 71 serve as reference points to ascertain the position of the lifts moving around the building core 71. To improve security there are redundant position tags so that in case one particular position tag or a sensor in a lift fails, it is still possible to ascertain the position of the lift using another pair of a position tag and the corresponding sensor positioned to read it.

Detail FIG. 11A shows a zoomed view of the lift stationed in the first floor with the emergency brakes 43 in the stowed position. The lift is kept in place by the stationary driving gears 30*a* and 30*b* engaged in the rack lattice 75*a*. The proper position to stop so the elevator doors align with the cabin doors is determined by the alignment of the sensor 41 with the position tag 76. In this position, the building electrode 77 aligns and has electrical contact with the cabin electrode 42 to supply energy to recharge the supercapacitor bank to allow the lift to move further.

FIG. 12 shows a more sophisticated building with two building cores 71*a* and 71*b* each one with multiple floor slabs 72*a* and 72*a* respectively. One elevator calling device 73 is installed next to each of the elevator doors 74*a*, 74*b*, etc. At least one common floor 78 connects both buildings and at least one lift access gate 79 provides access to a common parking lot 80 so a lift 36*a* equipped with ladders 64 can collect and drop passengers at the spot they parked their car 81.

FIG. 13 shows the same building illustrated in FIG. 12 from another view point and with the two building cores 71*a* and 71*b* and all floor slabs 72*a* and 72*a* drawn in phantom lines to allow the view of the interior of the building and of the installed equipment. As seen on FIG. 12, also in FIG. 13 a lift 36*a* equipped with ladders 64 is at the parking lot 80 collecting or dropping passengers at the spot they parked their car 81.

Inside both building cores 71*a* and 71*b*, four rack lattices 75*a*, 75*b*, 75*c*, and 75*d* are installed to provide lanes for the lifts to move and stop. The central lanes are intended for the lifts to stop (36*c*, 36*h*) so the passengers can get in and out. The outer lanes are intended for the lifts to move up (36*f*. 36*i*) or down (36*g*, 36*j*). A set of position tags 76*a*, 76*b*, etc. positioned at key points serve as reference points to ascertain the position of the various lifts in the system as they move around the area.

The lift track 82 allows the lifts to get off the rack lattice using their wheels to move from one building core to another (36*b*); go to the parking lot 80 (36*a*); or go to the buffer area 83 (36*d*) where lifts off duty can be temporarily removed from the system to save energy at reduced demand hours and wait until needed or receive maintenance (36*e*). It is also possible to use lift tracks in a specific floor to grant direct lift access to specific rooms or apartments inside the building for example to provide VIP access to their office or apartment. Custom private lifts can be assigned to a particular user and be made available on demand or at predefined times at the parking lot to collect his owner and be programmed to go directly to his intended destination without stopping for other passengers. The owner may download an elevator app into his mobile phone to give him additional features such as remote calling to call the lift when his car is approaching the parking lot and provide more information on his private lift such as current position, current speed, miles travelled, hours until next maintenance, etc.

More sophisticated applications are also possible with multiple buildings equipped with lift access gates allowing compatible lifts to move around and serve as personal moving vehicles between multiple sites in a campus, different buildings and parking lots in a big shopping mall, multiple airport terminals, etc.

DETAILED DESCRIPTION—ALTERNATIVE EMBODIMENT

FIG. 14 shows an alternative rack 84 that is constructed with conical rack teeth 85 with the same pitch in the x and y axis. The alternative rack 84 so constructed allows a propulsion screw 86*a*, 86*b* with a set of screw teeth 87*a*, 87*b* of the appropriate pitch to mesh with the alternative rack in either the x or the y axis. The propulsion screw 86*a* meshes with the alternative rack 84 along the x axis so as the propulsion screw 86*a* rotates it moves along the X axis. The propulsion screw 86*b* meshes with the alternative rack 84 along the Y axis so as the propulsion screw 86*a* rotates it moves along the Y axis.

To maintain the same relative position, the propulsion screws 86*a* and 86*b* must adjust for the movement of each other so that the rotation of one propulsion screw generates a second component to the rotation of the other propulsion screw and vice versa. The control system on the lift must therefore calculate the individual rotation of each propulsion screw to produce the intended movement.

For convenience and better visualization, the alternative rack 84 has been drawn longer in the x axis than in the v axis. There are however no limitations for the dimensions of the alternative rack 84 that can be constructed with as many conical rack teeth 85 as required in any direction. Furthermore, multiple alternative racks can be stacked along both the x and y directions to cover the area necessary to allow the intended range of movement for the propulsion screws in the x and y directions.

Detail FIG. 14A shows the screw teeth 87 of the propulsion screws 86 engaging on the conical rack teeth 85*a*, 85*b* of the alternative rack 84. The shapes of the screw teeth and the conical rack teeth are calculated to allow for smooth operation while maintaining material strength.

The alternative embodiment of the invention is basically identical to the first embodiment with the exception that the rack 32 is replaced by the alternative rack 84 and the driving gears 30 are replaced by the propulsion screws 86 and the control system of the lift is modified to calculate the individual rotation of each propulsion screw taking into account the other propulsion screw to produce the intended movement.

OPERATION—ALTERNATIVE EMBODIMENT

The operation of the alternative embodiment is the same as the first embodiment with the exception that the control system of the lift is modified to calculate the individual rotation of each propulsion screw taking into account the other propulsion screw to produce the intended movement.

CONCLUSION

The proposed new elevator system improves passenger mobility in a building or group of buildings allowing the lifts to move around freely. The proposed elevator system requires significant less floor space than traditional elevator systems to provide the same capacity to move the passengers up and down tall buildings.

The flexibility of the system offers an increased level of user mobility and allows for new options such as door to door lift access, using the same shafts for personnel and cargo lifts, individual custom and VIP lifts operating in the system without imposing high floor space penalties and many more.

Additionally, the proposed new elevator system offers easier maintenance with the possibility of temporarily moving individual lifts needing maintenance from the shafts to a convenient spot for the maintenance team or if necessary easily loading them into a truck to be sent to the manufacturer for more extensive repairs. The maintenance of one or more lifts has significant less impact on the overall capacity of the proposed elevator system when compared to traditional elevator systems.

What is claimed is:

1. An elevator system, comprising:

a rack lattice installed within at least one elevator shaft;

a lift having a plurality of driving trains, the lift configured to be movable along the rack lattice in an up, down, diagonal, left, and right direction depending on the geometry of the rack lattice;

the plurality of driving trains comprising:

a first gear mounted perpendicularly to a second gear, the first and second gear movable in a vertical, diagonal and horizontal direction along the rack lattice based on the geometry of the rack lattice; and wherein the rotation of the first gear moves the lift in a first direction along the rack lattice while sliding the perpendicularly mounted second gear through the rack lattice; and the second gear moves the lift in a second direction along the rack lattice while sliding the perpendicularly mounted first gear through the rack lattice.

2. The elevator system of claim 1, wherein the lift comprising a cabin configured to transport personnel and cargo along the rack lattice.

3. The elevator system of claim 1, wherein the lift comprising wheels to transport personnel and cargo outside of the elevator shaft.

4. The elevator system of claim 1, wherein the rack lattice is installed vertically within a plurality of elevator shafts and the rack lattice is installed horizontally between the plurality of elevator shafts; and the lift configured to be movable within and between the plurality of elevator shafts.

5. The elevator system of claim 1, comprising a left elevator shaft, a central elevator shaft and a right elevator shaft; and wherein the rack lattice is installed to connect the left, central and right elevator shafts; and the lift configured to be movable based on the geometry of the rack lattice within and between the left, central and right elevator shafts.

6. The elevator system of claim 1, comprising a left elevator shaft, a central elevator shaft and a right elevator shaft; and wherein the rack lattice is installed to connect the left elevator shaft with the central elevator shaft and the central elevator shaft with the right elevator shaft; and the lift configured to be movable in an up direction in one of at least the left elevator shaft or right elevator shaft, to be movable in a down direction in one of at least the right elevator shaft or left elevator shaft, and movable in a left or right direction to and from the left or right elevator shaft and the central elevator shaft.

7. The elevator system of claim 6, wherein the lift is opened to discharge or board personnel or cargo using any of the left, right or central elevator shaft.

8. The elevator system of claim 1 wherein the rack lattice comprising racks having frustum shaped teeth.

9. The elevator system of claim 1 comprising at least one gear movable in a vertical, diagonal and horizontal direction along the rack lattice.

10. The elevator system of claim 9 wherein the at least one gear having teeth with tapered ends for minimizing the gear from being dis-jarred from the rack lattice due to misalignment.

11. The elevator system of claim 1 wherein the first and second gears configured to rotate independently from one another.

12. The elevator system of claim 1 wherein the plurality of driving trains comprising:

a plurality of gear supports fixated to the wall of the lift body;

a plurality of gear holders; and wherein the gear holders allow the first and second gears to slide in and out with respect to the gear supports to accommodate variations in depth of the gear teeth within a frustum shaped teeth of the rack lattice ensuring that the gears remain always in contact with the rack lattice.

13. The elevator system of claim 1 wherein the plurality of driving trains comprising:

a plurality of engines; and a power source.

14. The elevator system of claim 1 wherein a driving train of the plurality of driving trains comprising an engine having a super capacitor as a power source, the supercapacitor rechargeable from the engine.

15. The elevator system of claim 1 wherein the plurality of driving trains comprising:

a plurality of shaft supports; and a plurality of engine supports each engine comprising a worm gear, a worm and worm shaft, each worm shaft held in place by a shaft support.

16. The elevator system of claim 1 wherein the rack lattice having conical rack teeth; and wherein a driving train of the plurality of driving trains comprising a first propulsion screw mounted perpendicularly to a second propulsion screw; and wherein the rotation of the first propulsion screw moves the lift in the first direction along the rack lattice while sliding the perpendicularly mounted second propulsion screw through the rack lattice and the rotation of the second propulsion screw moves the lift in the second direction along the rack lattice while sliding the perpendicularly mounted first propulsion screw through the rack lattice.

17. An autonomous mobile lift configured for use in an elevator system comprising:

a rack lattice comprising racks having frustum shaped teeth;

a driving train, the driving train comprising:

a first gear mounted perpendicularly to a second gear, the first and second gear movable in a vertical, diagonal and horizontal direction along the rack lattice based on the geometry of the rack lattice; and wherein the rotation of the first gear moves the lift in a first direction along the rack lattice while sliding the perpendicularly mounted second gear through the rack lattice; and the second gear moves the lift in a second direction along the rack lattice while sliding the perpendicularly mounted first gear through the rack lattice.

18. The autonomous mobile lift configured for use in an elevator system of claim 17 wherein the driving train comprising:

a plurality of gear supports fixated to a wall of a lift body;

a plurality of gear holders; and wherein the gear holders allow the first and second gears to slide in and out with respect to the gear supports to accommodate variations in depth of the gear teeth within the frustum shaped teeth of the racks ensuring that the gears remain always in contact with the racks of the rack lattice;

a plurality of shaft supports;

a plurality of engine supports;

a plurality of engines;

a power source rechargeable from the engines.

19. A method of controlling a number of lifts within an elevator system to increase capacity during peak hours of operation and decrease capacity during off-peak hours or remove lifts for maintenance, comprising:

installing a rack lattice in a vertical direction along at least one elevator shaft and in a horizontal direction along at least one floor slab connected to at least one elevator shaft;

controlling a lift having a driving train and wheels to enter an elevator shaft, the driving train having a first gear perpendicularly mounted to a second gear;

engaging a first gear of the driving train with the rack lattice to move the lift into and along a vertical direction within an elevator shaft;

sliding the second gear along the rack lattice as the first gear rotates;

engaging the second gear of the driving train to move the lift into and along a horizontal direction along a floor slab connected to the elevator shaft;

sliding the first gear along the rack lattice as the second gear rotates;

disengaging the driving train from the rack lattice;

powering the wheels to move the lift out of the elevator shaft.

* * * * *